US010353312B2

(12) United States Patent
Kamae et al.

(10) Patent No.: US 10,353,312 B2
(45) Date of Patent: Jul. 16, 2019

(54) TONER

(71) Applicant: CANON KABUSHIKI KAISHA, Tokyo (JP)

(72) Inventors: Kentaro Kamae, Kashiwa (JP); Ryuji Murayama, Nagareyama (JP); Junichi Tamura, Toride (JP); Hayato Ida, Toride (JP); Takashi Hirasa, Moriya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/056,630

(22) Filed: Aug. 7, 2018

(65) Prior Publication Data

US 2019/0049869 A1 Feb. 14, 2019

(30) Foreign Application Priority Data

Aug. 14, 2017 (JP) ..... 2017-156450

(51) Int. Cl.
*G03G 9/093* (2006.01)
*G03G 9/083* (2006.01)
*G03G 9/087* (2006.01)

(52) U.S. Cl.
CPC ..... *G03G 9/09364* (2013.01); *G03G 9/0833* (2013.01); *G03G 9/08704* (2013.01); *G03G 9/08728* (2013.01); *G03G 9/09321* (2013.01); *G03G 9/09328* (2013.01)

(58) Field of Classification Search
CPC ..... G03G 9/09364; G03G 9/09321; G03G 9/09328; G03G 9/09314; G03G 9/08704; G03G 9/08726; G03G 9/08728
USPC ..... 430/110.2
See application file for complete search history.

(56) References Cited

U.S. PATENT DOCUMENTS 4,259,426 A * 3/1981 Hasegawa ..... G03G 9/093 427/213.3
8,084,174 B2 12/2011 Hasegawa et al.
8,323,726 B2 12/2012 Naka et al.
8,921,023 B2 12/2014 Baba et al.
8,927,188 B2 1/2015 Naka et al.
8,974,994 B2 3/2015 Kamae et al.
8,986,914 B2 3/2015 Fujikawa et al.
9,057,970 B2 6/2015 Ida et al.
9,058,924 B2 6/2015 Komatsu et al.
9,063,443 B2 6/2015 Ishigami et al.
9,348,247 B2 3/2016 Ida et al.
9,540,483 B2 1/2017 Ida et al.
9,665,023 B2 5/2017 Kamae et al.
9,696,644 B2 7/2017 Ida et al.
9,897,934 B2 2/2018 Tamura et al.
9,915,885 B2 3/2018 Katsumata et al.
9,958,800 B2 * 5/2018 Chimoto ..... G03G 9/0804
9,969,834 B2 5/2018 Ohtsu et al.
10,012,918 B2 7/2018 Ishigami et al.
10,012,920 B2 7/2018 Shibata et al.
10,012,921 B2 7/2018 Kamae et al.
(Continued)

FOREIGN PATENT DOCUMENTS

JP 2004-046095 A 2/2004
JP 2011-128410 A 6/2011

OTHER PUBLICATIONS

U.S. Appl. No. 15/919,360, Ryuichiro Matsuo, filed Mar. 13, 2018.
U.S. Appl. No. 15/988,116, Naohiko Tsuchida, filed May 24, 2018.

*Primary Examiner* — Janis L Dote
(74) *Attorney, Agent, or Firm* — Venable LLP

(57) ABSTRACT

A toner including a toner particle having a core-shell structure that has a core formed from a resin 1 and a shell formed from a resin 2 on the surface of the core, wherein the resin 1 contains more than 50 mass % of an ester group-containing olefin-based copolymer, the ester group-containing olefin-based copolymer has a monomer unit Y1 represented by formula (1) below, and at least one type of monomer unit Y2 selected from the group consisting of monomer units represented by formula (2) and formula (3) below, the ester group concentration in the ester group-containing olefin-based copolymer is from 2 mass % to 18 mass %, and the resin 2 is an amorphous resin having a Tg value of from 50° C. to 70° C.

(1)

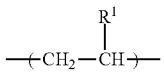

(2)

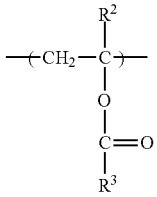

(3)

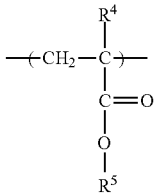

8 Claims, No Drawings

(56) References Cited

U.S. PATENT DOCUMENTS

| | | | |
|---|---|---|---|
| 10,078,281 | B2 | 9/2018 | Ida et al. |
| 2013/0108955 | A1 | 5/2013 | Shibata et al. |
| 2013/0202998 | A1 | 8/2013 | Higashi et al. |
| 2013/0244159 | A1 | 9/2013 | Ishigami et al. |
| 2014/0134535 | A1 | 5/2014 | Baba et al. |
| 2015/0099227 | A1 | 4/2015 | Ida et al. |
| 2017/0269493 | A1 | 9/2017 | Ohtsu et al. |
| 2018/0031990 | A1 | 2/2018 | Kamae et al. |
| 2018/0052402 | A1 | 2/2018 | Iwasaki et al. |
| 2018/0067410 | A1 | 3/2018 | Yamashita et al. |
| 2018/0107128 | A1 | 4/2018 | Miyakai et al. |
| 2018/0149990 | A1 | 5/2018 | Onozaki et al. |
| 2018/0149992 | A1 | 5/2018 | Onozaki et al. |
| 2018/0203370 | A1 | 7/2018 | Tamura et al. |

* cited by examiner

TONER

BACKGROUND OF THE INVENTION

Field of the Invention

The present invention relates to a toner used in electrophotography systems, electrostatic recording systems, electrostatic printing systems, and the like.

Description of the Related Art

As full-color electrophotographic copiers have become more widespread in recent years, there have of course been demands for higher speeds and higher image quality, but there have also been demands for additional improved performance relating to, for example, maintenance costs such as energy-saving performance and maintenance-free performance. In terms of specific energy-saving countermeasures, there have been demands for toners able to be fixed at lower temperatures in order to reduce the amount of electrical power consumed in fixing processes.

Here, Japanese Patent Application Publication No. 2004-046095 proposes a toner in which a crystalline polyester resin is used as a plasticizer for an amorphous polyester resin in order to achieve low temperature fixing.

Meanwhile, in terms of specific maintenance-free countermeasures, there have been demands for toners that are unlikely to degrade even after long term image output in order to suppress the frequency with which developers need to be replaced by service personnel.

Here, it has been proposed that by using a thermoplastic elastomer resin that exhibits rubber elasticity, inorganic fine particles that were present as spacers at toner particle surfaces are unlikely to become embedded and changes in toner fluidity and adhesive properties do not change, even after long term image output. Japanese Patent Application Publication No. 2011-128410 proposes a toner that contains an ethylene-based ester group-containing copolymer such as an ethylene-vinyl acetate copolymer or ethylene-methyl acrylate-based copolymer as a thermoplastic elastomer resin that exhibits rubber elasticity.

SUMMARY OF THE INVENTION

With respect to Japanese Patent Application Publication No. 2004-046095, however, because the viscosity of a plasticized toner decreases if a crystalline polyester resin is used, and because the fluidity of a toner decreases and the adhesive properties of the toner increase as a result of agitation of a developing device during long term image output, transfer efficiency decreases and image density decreases, meaning that maintenance such as developer replacement may be required.

With respect to Japanese Patent Application Publication No. 2011-128410, meanwhile, a toner that uses an ethylene-based ester group-containing copolymer as a main binder can achieve excellent transfer efficiency. Furthermore, even when fixing graphic images or the like, for which the toner laid-on level is high and a large amount of heat is required in order to melt the toner, it is thought that excellent low-temperature fixability is exhibited because the resin has a low glass transition temperature.

However, by carrying out diligent research, the inventors of the present invention found that a halftone image having a low toner laid-on level could not be fixed despite the fixing temperature being one at which a graphic image having a high toner laid-on level could be fixed, and the toner adhered to a fixing roller, that is, so-called cold offsetting occurred. This is because the ethylene-based ester group-containing copolymer is an elastic body, as explained below.

In addition, in cases where a copier is operated after a long period of inactivity, such as after a long term layoff, the volume resistance of the ethylene-based ester group-containing copolymer increases and the charge rising speed by triboelectric charging tends to be slow. As a result, the holding power of the toner, which is caused by electrostatic attraction of the magnetic carrier, weakens, meaning that toner scattering may occur and the inside of a copier may become contaminated.

Therefore, there is a trade-off between low-temperature fixability and high transfer efficiency during long term image output, and the purpose of the present invention is to eliminate this trade-off. That is, the purpose of the present invention is to provide a toner which exhibits excellent low-temperature fixability regardless of the toner laid-on level, can maintain excellent transfer efficiency during long term image output and can suppress toner scattering.

The present invention relates to a toner including a toner particle having a core-shell structure that has a core formed from a resin 1 and a shell formed from a resin 2 on the surface of the core, wherein the resin 1 contains more than 50 mass % of an ester group-containing olefin-based copolymer, the ester group-containing olefin-based copolymer has a monomer unit Y1 represented by formula (1) below, and at least one type of monomer unit Y2 selected from the group consisting of monomer units represented by formula (2) and formula (3) below, an ester group concentration in the ester group-containing olefin-based copolymer is from 2 mass % to 18 mass % relative to the total mass of the ester group-containing olefin-based copolymer, and the resin 2 is an amorphous resin having a Tg value of from 50° C. to 70° C.

(1)

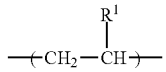

(2)

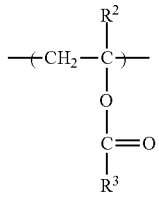

(3)

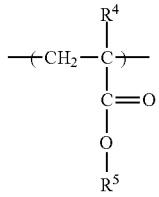

(Where, $R^1$ denotes H or $CH_3$, $R^2$ denotes H or $CH_3$, $R^3$ denotes $CH_3$ or $C_2H_5$, $R^4$ denotes H or $CH_3$, and $R^5$ denotes $CH_3$ or $C_2H_5$.)

According to the present invention, it is possible to provide a toner which exhibits excellent low-temperature fixability regardless of the toner laid-on level, can maintain excellent transfer efficiency during long term image output and can suppress toner scattering.

Further features of the present invention will become apparent from the following description of exemplary embodiments.

DESCRIPTION OF THE EMBODIMENTS

In the present invention, the terms "from XX to YY" and "XX-YY", which indicate numerical ranges, mean numerical ranges that include the lower limits and upper limits that are the end points of the ranges, unless otherwise noted.

The toner of the present invention is a toner including a toner particle having a core-shell type structure that has a core formed from a resin 1 and a shell formed from a resin 2 on the surface of the core, wherein the resin 1 contains more than 50 mass % of an ester group-containing olefin-based copolymer, the ester group-containing olefin-based copolymer has a monomer unit Y1 represented by formula (1) below, and at least one type of monomer unit Y2 selected from the group consisting of monomer units represented by formula (2) and formula (3) below, an ester group concentration in the ester group-containing olefin-based copolymer is from 2 mass % to 18 mass % relative to the total mass of the ester group-containing olefin-based copolymer, and the resin 2 is an amorphous resin having a Tg value of from 50° C. to 70° C.

(1)

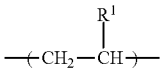

(2)

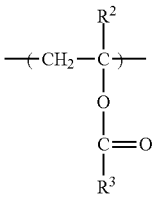

(3)

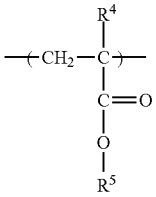

In the case of a toner that uses an ester group-containing olefin-based copolymer as a binder resin, a halftone image having a low toner laid-on level could not be fixed despite the fixing temperature being one at which a graphic image having a high toner laid-on level could be fixed, and the toner adhered to a fixing roller, that is, so-called cold offsetting occurred, as mentioned above. The inventors of the present invention worked to clarify the mechanism of this occurrence.

As a result, it was found that this type of occurrence is due to the ester group-containing olefin-based copolymer being an elastic body. Specifically, in cases where the fixing temperature is low, a toner particle acts as an elastic body because the temperature of the toner is similar to the melting point of the ester group-containing olefin-based copolymer. As a result, a molten toner particle is unlikely to become embedded in paper fibers and tends to exhibit lower adhesion to paper than polyester resins and the like.

However, in the case of graphic images having a high toner laid-on level, several toner layers are formed on the paper, meaning that even if deformation of the toner, which is an elastic body, is low, cohesive forces act between adjacent toner particles. As a result, the toner adheres as a surface, meaning that adhesion to paper increases and fixing is possible.

Meanwhile, in the case of a halftone image having a low toner laid-on level, only an approximately single toner layer is formed on the paper, and gaps are present between toner particles, meaning that if deformation of a toner particle, which is elastic body, is low, cohesive forces do not act between adjacent toner particles. As a result, single particles in the toner melt independently and toner particles adhere individually to the paper, meaning that adhesion to the paper weakens, fixing is not possible and cold offsetting occurs.

Furthermore, the paper surface is hydrophilic, whereas the ester group-containing olefin-based copolymer is hydrophobic due to having fewer polar groups than a polyester resin or the like, meaning that affinity with paper can be weakened. Therefore, a toner that uses an ester group-containing olefin-based copolymer as a binder resin has a low glass transition temperature, and therefore exhibits excellent melting properties, but in cases where some evaluation conditions are stringent, such as a halftone image in which the toner laid-on level is low, there is still room for improvement in terms of low-temperature fixability.

As a result, the inventors of the present invention carried out investigations into achieving excellent low-temperature fixability regardless of the toner laid-on level, in which an ester group-containing olefin-based copolymer was used as a main binder. As a result, by imparting the toner particle in the toner of the present invention with a core-shell structure, incorporating a large amount of an elastic body component in the resin that constitutes the core and incorporating a large quantity of a viscous body component in the resin that constitutes the shell, the inventors of the present invention found that it was possible to achieve excellent low-temperature fixability regardless of the toner laid-on level, maintain excellent transfer efficiency during long term image output, and suppress toner scattering.

The reason for this is thought to be as follows. In a halftone image having a low toner laid-on level, deformation of the elastic body that constitutes the core is low, but because deformation of the viscous body that constitutes the shell is high, the toner of the present invention can maintain an adhesive surface area with paper. Therefore, adhesive properties between the toner and paper increases and fixing becomes possible. Furthermore, this is also because the viscous body that constitutes the shell readily becomes embedded in paper fibers, and adhesive properties between the toner and paper can be further increased.

In the toner of the present invention, the resin 1 that constitutes the core contains more than 50 mass % of an ester group-containing olefin-based copolymer. In cases where the resin 1 contains more than 50 mass % of an ester group-containing olefin-based copolymer, the toner can function as an elastic body. Therefore, even if stress is applied to the toner as a result of agitation of a developing device during long term image output, the elastic body of the core acts as a cushioning agent and excellent transferability can be achieved.

Meanwhile, in cases where the content of an ester group-containing olefin-based copolymer is not more than 50 mass %, the toner cannot adequately function as an elastic body and excellent transferability cannot be achieved.

In addition, from the perspectives of low-temperature fixability, transfer efficiency and scattering resistance, it is preferable for the ester group-containing olefin-based copolymer to have a monomer unit Y1 represented by formula (1) and at least one type of monomer unit Y2 selected from the group consisting of monomer units represented by formula (2) and formula (3).

Moreover, monomer unit means a mode in which a monomer substance has reacted in a polymer.

A detailed explanation relating to the at least one type of monomer unit Y2 selected from the group consisting of monomer units represented by formula (2) and formula (3) will now be given.

The ester group-containing olefin-based copolymer is preferably at least one type selected from among the copolymers below:

an ethylene-vinyl acetate copolymer which has monomer units represented by formulae (1) and (2) and in which $R^1$ is H, $R^2$ is H and $R^3$ is $CH_3$;

an ethylene-methyl acrylate copolymer which has monomer units represented by formulae (1) and (3) and in which $R^1$ is H, $R^4$ is H and $R^5$ is $CH_3$;

an ethylene-ethyl acrylate copolymer which has monomer units represented by formulae (1) and (3) and in which $R^1$ is H, $R^4$ is H and $R^5$ is $C_2H_5$; and an ethylene-methyl methacrylate copolymer which has monomer units represented by formulae (1) and (3) and in which $R^1$ is H, $R^4$ is $CH_3$ and $R^5$ is $CH_3$.

Because the ester group-containing olefin-based copolymer can be designed so as to have a lower melting point than polyethylene, low-temperature fixability is improved. In addition, by introducing ester groups, which are polar groups, into non-polar polyethylene, it is possible to improve affinity with paper and therefore improve low-temperature fixability.

Furthermore, the ester group-containing olefin-based copolymer can exhibit rubber elasticity as an elastomer, and is therefore preferred from the perspective of transfer efficiency also.

Furthermore, compared to polyethylene, which has high volume resistance, the ester group-containing olefin-based copolymer contains ester groups, which are polar groups, and can therefore lower volume resistance to no small extent. Therefore, the ester group-containing olefin-based copolymer is also preferred from the perspectives of speeding up charge rising speed by triboelectric charging and achieving scattering resistance.

In addition, from the perspectives of low-temperature fixability, scattering resistance and transfer efficiency, the ester group concentration in the ester group-containing olefin-based copolymer must be from 2.0 mass % to 18.0 mass % relative to the total mass of the ester group-containing olefin-based copolymer. This ester group concentration is preferably from 11.0 mass % to 15.0 mass %. The ester group concentration indicates the extent to which ester group [—C(═O)O—] binding segments are contained in the resin in terms of mass %, and is specifically expressed by the formula below.

In cases where the ester group concentration is from 2.0 mass % to 18.0 mass % relative to the total mass of the ester group-containing olefin-based copolymer, it is possible to design a lower melting point than polyethylene within a range whereby the storability of the toner can be maintained, and low-temperature fixability can therefore be improved regardless of the toner laid-on level. In addition, it is possible to incorporate ester groups, which are more polar than polyethylene, within a range whereby the storability of the toner can be maintained, affinity between the toner and paper can be improved, and low-temperature fixability is therefore improved.

Furthermore, the ester group concentration is a concentration whereby at least one of a monomer unit represented by formula (2) and a monomer unit represented by formula (3) can bond to a monomer unit represented by formula (1) and exhibit rubber elasticity as an elastomer, and can therefore improve transfer efficiency.

Furthermore, it is possible to incorporate ester groups, which are more polar than polyethylene, within a range whereby the storability of the toner can be maintained, and volume resistance can be lowered to no small extent. Therefore, the ester group concentration is also preferred from the perspectives of increasing the speed of charge rising by triboelectric charging and achieving scattering resistance.

$$\text{Ester group concentration (units: mass \%)} = [(N \times 44)/\text{number average molecular weight}] \times 100$$

(Here, N is the average number of ester groups per molecule of the ester group-containing olefin-based copolymer, and 44 is the formula weight of an ester group [—C(═O)O—]. The number average molecular weight is the number average molecular weight of the ester group-containing olefin-based copolymer.)

In the toner of the present invention, the resin 2 that constitutes the shell must be an amorphous resin having a glass transition temperature Tg of from 50° C. to 70° C. If the Tg value of the resin 2 is from 50° C. to 70° C., the toner can exhibit the function of a viscous body. Therefore, because the resin 2 that can serve as a viscous body during fixing undergoes significant deformation and can maintain an adhesive surface area, adhesion between the toner and paper increases and it is possible to achieve excellent low-temperature fixability regardless of the toner laid-on level. The Tg value of the resin 2 is preferably from 55° C. to 65° C.

Furthermore, the viscous body of the resin 2 that constitutes the shell readily becomes embedded in paper fibers, and because adhesion to paper is further increased, excellent low-temperature fixability can be achieved regardless of the toner laid-on level.

Meanwhile, in cases where the Tg value of the resin 2 is lower than 50° C., it is not possible to ensure storability of the toner. In addition, the Tg value of the resin 2 may be exceeded as a result of increased temperature inside a copier during long term image output in high temperature and high humidity environments. Because the resin 2 that constitutes the shell softens in such cases, excellent transferability cannot be achieved, regardless of the cushioning properties of the elastic body of the core.

Therefore, the toner of the present invention exhibits excellent low-temperature fixability regardless of toner laid-on level, can maintain excellent transfer efficiency during long term image output and can suppress toner scattering.

In addition, it is preferable for the resin 2 that forms the shell to contain more than 50 mass % of at least one of a polyester resin and a styrene-acrylic resin from the perspectives of low-temperature fixability and scattering resistance regardless of the toner laid-on level. This content is more preferably at least 60 mass %. The upper limit is not particularly limited, but is preferably not more than 100 mass %.

The polyester resin and styrene-acrylic resin exhibit high affinity for ester groups in the ester group-containing olefin-based copolymer of the resin 1 that forms the core, can form a uniform shell layer, and enable triboelectric charging by a specific surface area sufficiently. Therefore, the polyester resin and styrene-acrylic resin are also preferred from the perspective of scattering resistance by being able to increase the speed of charge rising.

Furthermore, because the resin 2 contains more than 50 mass % of at least one of a polyester resin and a styrene-acrylic resin, the resin 2 has more than enough polar groups. Therefore, the polyester resin and styrene-acrylic resin are also preferred from the perspective of scattering resistance because the volume resistance of the resin 2 falls within an appropriate range and it is possible to increase the speed of charge rising by triboelectric charging.

In addition, the resin 2 can exhibit the function of a viscous body, and the viscous body of the resin 2 undergoes significant deformation during fixing and can maintain an adhesive surface area, meaning that adhesion between the toner and paper increases and it is possible to achieve excellent low-temperature fixability.

In addition, it is preferable for the resin 1 that forms the core to contain an olefin-based copolymer containing a carboxyl group-containing acid group from the perspectives of low-temperature fixability and scattering resistance regardless of the toner laid-on level. The olefin-based copolymer containing a carboxyl group-containing acid group is preferably a copolymer of a monomer that forms the monomer unit Y1 represented by formula (1) above (ethylene or propylene) and a monomer having a carboxyl group (for example, a random copolymer, a block copolymer, a graft copolymer or a copolymer obtained by modifying thereof by means of a polymerization reaction).

Examples of carboxyl group-containing monomers include acrylic acid, methacrylic acid, maleic acid, maleic anhydride, itaconic acid, methyl (meth)acrylate, ethyl (meth)acrylate and butyl (meth)acrylate.

The olefin-based copolymer containing a carboxyl group-containing acid group has a similar skeleton to the ester group-containing olefin-based copolymer contained in the core, and therefore exhibits high compatibility with the ester group-containing olefin-based copolymer. Furthermore, the olefin-based copolymer containing a carboxyl group-containing acid group has a polar group, and therefore forms hydrogen bonds with the resin that forms the shell and exhibits high affinity for the shell resin.

By containing an olefin-based copolymer containing a carboxyl group-containing acid group, the resin 1 increases adhesive strength between the core and the shell and can maintain the shell for a long period of time.

Furthermore, because carboxyl groups in the olefin-based copolymer containing a carboxyl group-containing acid group form hydrogen bonds with hydroxyl groups at the paper surface, adhesion between the toner and the paper is increased and low-temperature fixability is therefore improved.

In addition, it is preferable for the melting point Tp of the ester group-containing olefin-based copolymer, as measured using a differential scanning calorimeter DSC, to be from 70° C. to 90° C. from the perspectives of low-temperature fixability and transfer efficiency regardless of the toner laid-on level. This Tp value is more preferably from 80° C. to 90° C.

The melting point can be controlled by altering the ester group concentration in the ester group-containing olefin-based copolymer, and the melting point can be lowered by increasing the ester group concentration.

In cases where the melting point of the ester group-containing olefin-based copolymer falls within the range mentioned above, it is possible to maintain the storability of the toner while lowering the viscosity when melting the toner during fixing, thereby improving low-temperature fixability and storability. In addition, in cases where the melting point falls within the range mentioned above, the ester group concentration is an appropriate value, meaning that it is possible to exhibit rubber elasticity as an elastomer and improve transfer efficiency.

In addition, it is preferable for the value of tan $\delta_{1(70°\ C.-90°\ C.)}$ to always be not more than 1.0 within the temperature range from 70° C. to 90° C. on a loss tangent (tan $\delta_1$) curve measured by a dynamic viscoelasticity test of the resin 1 that forms the core, and it is preferable for the value of tan $\delta_{2(70°\ C.-90°\ C.)}$ to always be at least 1.0 within the temperature range from 70° C. to 90° C. on a loss tangent (tan $\delta_2$) curve measured by the dynamic viscoelasticity test of the resin 2 that forms the shell. Due to this configuration, low-temperature fixability is improved regardless of the toner laid-on level, and transfer efficiency is also improved.

It is more preferable for the value of tan $\delta_{1(70°\ C.-90°\ C.)}$ to always be not more than 0.9. The lower limit is not particularly limited, but is always preferably at least 0.01. tan $\delta_{1(70°\ C.-90°\ C.)}$ can be controlled by adjusting the ester group concentration or molecular weight of the ester group-containing olefin-based copolymer.

It is more preferable for the value of tan $\delta_{2(70°\ C.-90°\ C.)}$ to always be at least 2.0. The upper limit is not particularly limited, but is always preferably not more than 3.0. tan $\delta_{2(70°\ C.-90°\ C.)}$ can be controlled by adjusting the glass transition temperature or molecular weight.

In cases where the values for tan $\delta_{1(70°\ C.-90°\ C.)}$ and tan $\delta_{2(70°\ C.-90°\ C.)}$ fall within the ranges mentioned above, the resin 1 that forms the core acts as an elastic body and the resin 2 that forms the shell acts as a viscous body within the temperature region of the toner during fixing. Therefore, in a halftone image having a low toner laid-on level, deformation of the resin 1 is low, but because deformation of the resin 2 is high, it is possible to maintain an adhesive surface area with paper, and adhesion between the toner and paper increases, meaning that low-temperature fixability is improved.

In addition, the viscous body of the resin 2 readily becomes embedded in paper fibers and can further increase adhesive properties between the toner and paper, and is therefore preferred. Furthermore, the toner can exhibit the function of an elastic body, and even if stress is applied to the toner as a result of agitation of a developing device during long term image output, the elastic body of the core acts as a cushioning agent and transfer efficiency is improved.

<Ester Group-Containing Olefin-Based Copolymer>

If the total mass of the ester group-containing olefin-based copolymer is denoted by Z1 and the masses of the monomer units represented by formula (1), formula (2) and formula (3) are denoted by 1, m and n respectively, it is preferable for the value of (1+m+n)/Z1 to be from 0.80 to 1.00. Due to this configuration, low-temperature fixability, scattering resistance and transfer efficiency are improved. This value is more preferably from 0.95 to 1.00, and further preferably 1.00.

Monomer units represented by formula (4) and formula (5) can be given as examples of monomer units able to be contained in the ester group-containing olefin-based copolymer in addition to monomer units Y1 and Y2. These monomer units may be introduced by adding corresponding monomers when carrying out the copolymerization reaction for producing the ester group-containing olefin-based copolymer or by modifying the ester group-containing olefin-based copolymer by means of a polymerization reaction.

(4)

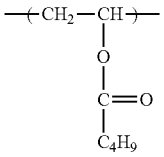

(5)

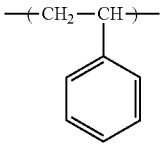

The resin 1 must contain more than 50 mass %, and preferably at least 70 mass %, of the ester group-containing olefin-based copolymer. Due to this configuration, low-temperature fixability and transfer efficiency are improved. The upper limit is not particularly limited, but is preferably not more than 90 mass %.

The ester group-containing olefin-based copolymer preferably has a glass transition temperature of not more than 0° C. Low-temperature fixability improves as the proportion of an ester group-containing olefin-based copolymer having a glass transition temperature of not more than 0° C. increases. In addition, as the proportion of the ester group-containing olefin-based copolymer increases, the viscosity stress effect of the toner following melting and elastomer performance increase, meaning that transfer efficiency is improved.

The acid value Av of the ester group-containing olefin-based copolymer is preferably from 0 mg KOH/g to 10 mg KOH/g, and more preferably from 0 mg KOH/g to 5 mg KOH/g, and is preferably essentially 0 mg KOH/g from the perspective of transfer efficiency. If the acid value of the ester group-containing olefin-based copolymer falls within the range mentioned above, moisture absorption by the toner is low, meaning that it is possible to suppress an increase in non-electrostatic adhesive force to an electrostatic latent image bearing member caused by liquid crosslinking, and also possible to achieve high transfer efficiency.

It is preferable for the ester group-containing olefin-based copolymer to have a melt flow rate MFR of from 5 g/10 min to 30 g/10 min from the perspectives of low-temperature fixability and hot offset resistance. The melt flow rate is measured in accordance with JIS K 7210, at a temperature of 190° C. and a load of 2160 g. In cases where the resin component contains a plurality of ester group-containing olefin-based copolymers, the melt flow rate is measured under the conditions mentioned above after melting and mixing the copolymers.

In cases where the melt flow rate falls within the range mentioned above, excellent melting properties and good low-temperature fixability can be achieved. Furthermore, the viscosity of the toner following melting can be maintained within an appropriate range. That is, the toner melts, deforms and is fixed to the paper at the outlet of a fixing nip, but viscosity stress can be exhibited. Therefore, because the toner can remain on the paper without winding around a fixing film, hot offset resistance can be improved.

The melt flow rate can be controlled by altering the molecular weight of the ester group-containing olefin-based copolymer, and it is possible to lower the melt flow rate by increasing the molecular weight. Specifically, the weight average molecular weight Mw of the ester group-containing olefin-based copolymer is preferably from 50,000 to 500,000 from the perspective of achieving both low-temperature fixability and hot offset resistance, and is more preferably at least 100,000.

The fracture elongation of the ester group-containing olefin-based copolymer is preferably at least 300% from the perspective of low-temperature fixability, and is more preferably at least 500%. If the fracture elongation is at least 300%, the bending resistance of a toner-fixed article is improved. The fracture elongation is measured under conditions based on JIS K 7162. In cases where the resin contains a plurality of ester group-containing olefin-based copolymers, the fracture elongation is measured under the conditions mentioned above after melting and mixing the copolymers.

<Olefin-Based Copolymer Containing Carboxyl Group-Containing Acid Group>

As mentioned above, the olefin-based copolymer containing a carboxyl group-containing acid group is preferably a copolymer of a monomer that forms the monomer unit Y1 represented by formula (1) and a monomer having a carboxyl group (for example, a random copolymer, a block copolymer, a graft copolymer or a copolymer obtained by modifying thereof by means of a polymerization reaction).

In addition, it is possible to incorporate monomer units other than the monomer unit Y1 represented by formula (1) above and units derived from carboxyl group-containing monomers as long as physical properties of the copolymer are not adversely affected. The content of monomer units other than the monomer unit Y1 represented by formula (1) and units derived from carboxyl group-containing monomers is, relative to the total mass of the olefin-based copolymer containing a carboxyl group-containing acid group, preferably 20 mass % or less, more preferably 10 mass % or less, and further preferably 5 mass % or less, and is preferably essentially 0 mass % from the perspectives of scattering resistance and low-temperature fixability.

In addition, the monomer that forms the monomer unit Y1 represented by formula (1) is preferably ethylene from the perspective of being able to achieve a low melting point, and the carboxyl group-containing monomer is preferably acrylic acid or methacrylic acid. That is, if the olefin-based copolymer containing a carboxyl group-containing acid group is an ethylene-acrylic acid copolymer or an ethylene-methacrylic acid copolymer, adhesion between the toner and paper is readily improved.

From the perspectives of transfer efficiency and low-temperature fixability, the content of the olefin-based copolymer containing a carboxyl group-containing acid group in the resin 1 is preferably at least 10 mass % but less than 50 mass %, and more preferably from 10 mass % to 30 mass %. In cases where the content of the olefin-based copolymer containing a carboxyl group-containing acid group falls within the range mentioned above, an appropriate amount of moisture in the air is absorbed and the surface resistance of the toner falls within an appropriate range, meaning that toner scattering can be suppressed. Furthermore, because carboxyl groups form hydrogen bonds with hydroxyl groups at the paper surface and adhesion between the toner and paper increases, low-temperature fixability is improved.

In addition, the resin 2 that forms the shell may also contain the olefin-based copolymer containing a carboxyl group-containing acid group, and the content thereof is preferably from 0 mass % to 10 mass %.

The acid value of the olefin-based copolymer containing a carboxyl group-containing acid group is preferably from 50 mg KOH/g to 300 mg KOH/g from the perspectives of shell adhesion, transfer efficiency and low-temperature fixability.

If the acid value falls within the range mentioned above, hydrogen bonds are formed with the amorphous resin contained in the resin 2, and the strength of the shell increases. In particular, the strength of the shell is significantly improved in cases where the resin 2 contains at least one of a polyester resin having such an acid value and a styrene-acrylic resin having such an acid value. In addition, if the acid value of the olefin-based copolymer containing a carboxyl group-containing acid group falls within the range mentioned above, an appropriate amount of moisture in the air is absorbed and the surface resistance of the toner particle falls within an appropriate range, meaning that toner scattering can be suppressed. Furthermore, because carboxyl groups form hydrogen bonds with hydroxyl groups at the paper surface and adhesion between the toner and paper increases, low-temperature fixability is improved.

It is preferable for the olefin-based copolymer containing a carboxyl group-containing acid group to have a melt flow rate of from 10 g/10 min to 200 g/10 min from the perspective of low-temperature fixability. The melt flow rate is measured in accordance with JIS K 7210, at a temperature of 190° C. and a load of 2160 g. In cases where the resin component contains a plurality of olefin-based copolymers containing a carboxyl group-containing acid group, the melt flow rate is measured under the conditions mentioned above after melting and mixing the copolymers.

In cases where the melt flow rate falls within the range mentioned above, the olefin-based copolymer containing a carboxyl group-containing acid group is compatible with the ester group-containing olefin-based copolymer, meaning that the olefin-based copolymer containing a carboxyl group-containing acid group can be uniformly incorporated inside a toner particle. Therefore, stable low-temperature fixability can be achieved. The melt flow rate can be controlled by altering the molecular weight of the olefin-based copolymer containing a carboxyl group-containing acid group, and it is possible to lower the melt flow rate by increasing the molecular weight.

Specifically, the weight average molecular weight Mw of the olefin-based copolymer containing a carboxyl group-containing acid group is preferably from 50,000 to 500,000 from the perspective of low-temperature fixability, and is more preferably at least 70,000.

The fracture elongation of the olefin-based copolymer containing a carboxyl group-containing acid group is preferably at least 300% from the perspective of low-temperature fixability, and is more preferably at least 500%. If the fracture elongation is at least 300%, the bending resistance of a toner-fixed article is improved. The fracture elongation is measured under conditions based on JIS K 7162. In cases where the resin contains a plurality of olefin-based copolymers containing a carboxyl group-containing acid group, the fracture elongation is measured under the conditions mentioned above after melting and mixing the copolymers.

It is preferable for the olefin-based copolymer containing a carboxyl group-containing acid group to have a melting point of from 50° C. to 100° C. from the perspectives of low-temperature fixability and storability. In cases where the melting point falls within the range mentioned above, it is possible to maintain the storability of the toner while lowering the viscosity when melting the toner during fixing, thereby improving low-temperature fixability and storability.

<Amorphous Resin>

In the present invention, a variety of resin compounds known as conventional amorphous resins may be used in the resin 2 that constitutes the shell as long as the glass transition temperature Tg of the resin 2 falls within the range of from 50° C. to 70° C.

Examples of the amorphous resin include phenol resins, natural resin-modified phenol resins, natural resin-modified maleic resins, acrylic resins, (meth)acrylic resins, poly(vinyl acetate) resins, silicone resins, polyester resins, polyurethanes, polyamide resins, furan resins, epoxy resins, xylene resins, poly(vinyl butyral) resins, terpene resins, coumarone-indene resins and petroleum-based resins. As mentioned above, at least one of a polyester resin and a styrene-acrylic resin is preferred from the perspectives of low-temperature fixability and scattering resistance regardless of the toner laid-on level.

In cases where a polyester resin is used in the resin 2 that constitutes the shell resin, the following structures can be used.

Examples of monomers able to be used in polyester units of the polyester resin include polyhydric alcohols (dihydric and trihydric or higher alcohols), polyhydric carboxylic acids (divalent or trivalent or higher carboxylic acids), and acid anhydrides and lower alkyl esters thereof.

A polyhydric alcohol monomer listed below can be used in the polyester resin.

Examples of dihydric alcohol components include ethylene glycol, propylene glycol, 1,3-butane diol, 1,4-butane diol, 2,3-butane diol, diethylene glycol, triethylene glycol, 1,5-pentane diol, 1,6-hexane diol, neopentyl glycol, 2-ethyl-1,3-hexane diol, hydrogenated bisphenol A, bisphenols represented by formula (A) and derivatives thereof; and diols represented by formula (B).

(A)

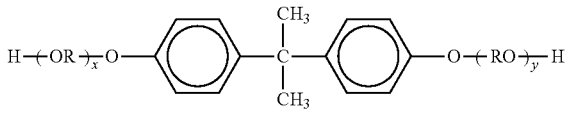

(Wherein, R is an ethylene or propylene group, x and y are each an integer of at least 0, and the average value of x+y is from 0 to 10.)

(B)

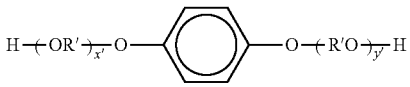

(Wherein, R' denotes

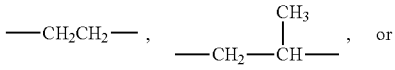

, or

-continued

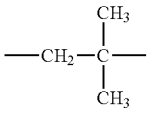

x' and y' are each an integer of at least 0, and the average value of x'+y' is 0 to 10.)

Examples of trihydric or higher alcohols include sorbitol, 1,2,3,6-hexane tetraol, 1,4-sorbitan, pentaerythritol, dipentaerythritol, tripentaerythritol, 1,2,4-butane triol, 1,2,5-pentane triol, glycerol, 2-methylpropane triol, 2-methyl-1,2,4-butane triol, trimethylolethane, trimethylolpropane and 1,3,5-trihydroxymethylbenzene. Of these, glycerol, trimethylolpropane and pentaerythritol are preferred. It is possible to use one of these dihydric or trihydric or higher alcohols in isolation, or a plurality thereof.

A polyhydric carboxylic acid monomer listed below can be used in the polyester resin.

Examples of divalent carboxylic acid components include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, n-octylsuccinic acid, isooctenylsuccinic acid, isooctylsuccinic acid, and anhydrides and lower alkyl esters of these acids. Of these, maleic acid, fumaric acid, terephthalic acid and n-dodecenylsuccinic acid are preferred.

Examples of trivalent or higher carboxylic acids, anhydrides thereof and lower alkyl esters thereof include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, empol trimer acid, and acid anhydrides and lower alkyl esters of these acids.

Of these, 1,2,4-benzenetricarboxylic acid, that is, trimellitic acid, and derivatives thereof are preferred due to being inexpensive and facilitating reaction control. It is possible to use one of these divalent or trivalent or higher carboxylic acids in isolation, or a plurality thereof.

The method for producing the polyester resin is not particularly limited, with a publicly known method able to be used. For example, the polyester resin can be produced by simultaneously charging the alcohol monomer and carboxylic acid monomer and then polymerizing by means of an esterification reaction or a transesterification reaction, and a condensation reaction. In addition, the polymerization temperature is not particularly limited, but preferably falls within the range of from 180° C. to 290° C. When polymerizing polyester units, it is possible to use as a polymerization catalyst such as a titanium-based catalyst, a tin-based catalyst, zinc acetate, antimony trioxide or germanium dioxide. A polyester resin polymerized using a tin-based catalyst is more preferred.

In addition, the polyester resin may be a hybrid resin that contains another resin component in addition to a polyester resin. An example thereof is a hybrid resin of a polyester resin and a vinyl-based resin. A method for obtaining a reaction product of a vinyl-based resin or vinyl-based copolymer unit and a polyester resin, such as a hybrid resin, is preferably a method in which a polymer containing monomer component able to react with a vinyl-based resin or vinyl-based copolymer unit and with a polyester resin is present, thereby subjecting one or both resins to a polymerization reaction.

Among monomers that constitute the polyester resin component, examples of monomers able to react with a vinyl-based copolymer include unsaturated dicarboxylic acids, such as fumaric acid, maleic acid, citraconic acid and itaconic acid, and anhydrides thereof. Meanwhile, among monomers that constitute the vinyl-based resin component, examples of monomers able to react with the polyester resin component include monomers having a carboxyl group or hydroxyl group and acrylic acid esters and methacrylic acid esters.

In addition, it is preferable for the acid value of the polyester resin to be from 5 mg KOH/g to 30 mg KOH/g in order to increase adhesion to the core resin and increase the strength of the shell. Furthermore, it is preferable for the hydroxyl value of the polyester resin to be from 20 mg KOH/g to 70 mg KOH/g from the perspectives of low-temperature fixability and storability.

In cases where a styrene-acrylic resin is used in the resin 2 that constitutes the shell resin, the following structures can be used.

The styrene-acrylic resin is a copolymer of styrene and an acrylic monomer.

Examples of acrylic monomers include acrylic acid and methacrylic acid; and acrylic acid ester-based monomers and methacrylic acid ester-based monomers, such as methyl acrylate, methyl methacrylate, ethyl acrylate, ethyl methacrylate, propyl acrylate, propyl methacrylate, butyl acrylate, butyl methacrylate, octyl acrylate, octyl methacrylate, dodecyl acrylate, dodecyl methacrylate, stearyl acrylate, stearyl methacrylate, behenyl acrylate, behenyl methacrylate, 2-ethylhexyl acrylate, 2-ethylhexyl methacrylate, dimethylaminoethyl acrylate, dimethylaminoethyl methacrylate, diethylaminoethyl acrylate and diethylaminoethyl methacrylate.

In addition, an aromatic vinyl monomer may be used in addition to styrene and the acrylic monomer. Examples of the aromatic vinyl monomer include styrene derivatives such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene.

A crosslinking agent may be used in order to increase the mechanical strength of the shell and control the molecular weight of the styrene-acrylic resin.

With regard to crosslinking agents, examples of difunctional crosslinking agents include divinylbenzene, bis(4-acryloxypolyethoxyphenyl)propane, ethylene glycol diacrylate, 1,3-butylene glycol diacrylate, 1,4-butane diol diacrylate, 1,5-pentane diol diacrylate, 1,6-hexane diol diacrylate, neopentyl glycol diacrylate, diethylene glycol diacrylate, triethylene glycol diacrylate, tetraethylene glycol diacrylate, polyethylene glycol #200, #400 and #600, dipropylene glycol diacrylate, polypropylene glycol diacrylate, polyester type diacrylates (MANDA available from Nippon Kayaku Co., Ltd.) and compounds obtained by replacing the diacrylates mentioned above with dimethacrylates.

Examples of polyfunctional crosslinking agents include pentaerythritol triacrylate, trimethylolethane triacrylate, trimethylolpropane triacrylate, tetramethylolmethane tetraacrylate, oligoester acrylates, compounds obtained by replacing these acrylates with methacrylates, 2,2-bis(4-methacryloxypolyethoxyphenyl)propane, diallyl phthalate, triallyl cyanurate, triallyl isocyanurate and triallyl trimellitate.

Moreover, the number average molecular weight (Mn) of the styrene-acrylic resin, as measured by gel permeation chromatography (GPC), is preferably from 5000 to 100,000. The weight average molecular weight (Mw) is preferably from 7000 to 14,000.

The method for producing the styrene-acrylic resin is not particularly limited. For example, it is possible to use (1) a solid state polymerization method in which monomers are polymerized in a substantially solvent-free state, (2) a solution polymerization method in which all of the monomers, all of the polymerization initiator and solvent to be used in the polymerization are added and polymerized all at once, or (3) a dropping polymerization method in which polymerization is carried out while adding monomers to the polymerization reaction. In addition, products obtained using normal pressure polymerization methods and pressurized polymerization methods can be used.

In addition, it is preferable for the acid value of the styrene-acrylic resin to be from 5 mg KOH/g to 30 mg KOH/g in order to increase adhesion to the core resin and increase the strength of the shell. The acid value of the styrene-acrylic resin can be adjusted by controlling the copolymerization ratio of a carboxylic group-containing acrylic monomer, such as acrylic acid or methacrylic acid, in the styrene-acrylic resin.

<Binder Resin>

The resin 1 that forms the core and the resin 2 that forms the shell can be given as examples of the binder resin. The resin 1 that forms the core may additionally contain another polymer in addition to the ester group-containing olefin-based copolymer and acid group-containing olefin-based copolymer. Specifically, it is possible to use the following polymers and the like.

Homopolymers of styrene and substituted products thereof, such as polystyrene, poly-p-chlorostyrene and polyvinyltoluene; styrene-based copolymers such as styrene-p-chlorostyrene copolymers, styrene-vinyltoluene copolymers, styrene-vinylnaphthalene copolymers, styrene-acrylic acid ester copolymers and styrene-methacrylic acid ester copolymers; poly(vinyl chloride), phenol resins, naturally modified phenol resins, natural resin-modified maleic acid resins, acrylic resins, methacrylic resins, poly(vinyl acetate), silicone resins, polyester resins, polyurethanes, polyamide resins, furan resins, epoxy resins, xylene resins, polyethylene resins, polypropylene resins, and the like.

Similarly, the resin 2 that constitutes the shell may also additionally contain a polymer such as those mentioned above in addition to the polyester resin or styrene-acrylic resin.

<Release Agent>

The toner particle may contain a release agent. A silicone oil is preferred as the release agent. Dimethylsilicone oils, methylphenylsilicone oils, methylhydrogensilicone oils, amino-modified silicone oils, carboxyl-modified silicone oils, alkyl-modified silicone oils, fluorine-modified silicone oils, and the like, can be used as the silicone oil. Of these, dimethylsilicone oils are preferred from the perspective of transfer efficiency.

Meanwhile, in cases where the silicone oil is a dimethylsilicone oil, affinity for the resin 1 that forms the core is higher than that for the resin 2 that forms the shell, meaning that the silicone oil is enclosed inside the toner and transfer efficiency is improved.

In addition, the content of the silicone oil is preferably from 15 parts by mass to 30 parts by mass relative to a total of 100 parts by mass of the resin 1 that forms the core and the resin 2 that forms the shell from the perspective of transfer efficiency. The amount of silicone oil at the surface of a toner particle varies according to the viscosity and added quantity of the silicone oil and the toner production method. In cases where the content of the silicone oil falls within the range mentioned above, the amount of silicone compounds present at the surface of a toner particle can be controlled within an appropriate range, meaning that transfer efficiency is improved.

In addition, the silicone oil preferably has a kinematic viscosity at 25° C. of from 300 $mm^2/s$ to 1000 $mm^2/s$ from the perspective of transfer efficiency. The amount of silicone compound at the toner surface varies according to the viscosity and added quantity of the silicone oil and the toner production method. In cases where the kinematic viscosity falls within the range mentioned above, the amount of silicone oil present at the surface of a toner particle can be controlled within an appropriate range, meaning that transfer efficiency is improved. A correlation can be seen between the kinematic viscosity at 25° C. of the silicone oil and non-electrostatic adhesive force to an electrostatic latent image bearing member, and in cases where the kinematic viscosity falls within the range mentioned above, non-electrostatic adhesive force to an electrostatic latent image bearing member decreases and transfer efficiency is improved.

<Plasticizer (Aliphatic Hydrocarbon Compound)>

From the perspective of low-temperature fixability, the toner particles preferably contain an aliphatic hydrocarbon compound having a melting point of from 50° C. to 100° C. in an amount of from 1 part by mass to 40 parts by mass relative to a total of 100 parts by mass of the resin 1 and the resin 2. When heated, the aliphatic hydrocarbon compound can plasticize the ester group-containing olefin-based copolymer. Therefore, by incorporating an aliphatic hydrocarbon compound in the toner, the ester group-containing olefin-based copolymer, which can advantageously form a matrix in a toner particle, is plasticized when the toner is thermally fixed, and low-temperature fixability is improved.

Furthermore, an aliphatic hydrocarbon compound having a melting point of from 50° C. to 100° C. can also act as a nucleating agent for the ester group-containing olefin-based copolymer. Therefore, microscopic movements of the ester group-containing olefin-based copolymer are suppressed, and charging performance is improved. This content is more preferably from 10 parts by mass to 30 parts by mass from the perspectives of low-temperature fixability and charging performance.

Specific examples of the aliphatic hydrocarbon compound include saturated hydrocarbons having from 20 to 60 carbon atoms, such as hexacosane, tricosane and hexatriacontane. In addition, it is also possible to use HNP-51 (available from Nippon Seiro Co., Ltd.), or the like.

<Colorant>

The toner particles may contain a colorant. Examples of the colorant include those listed below.

Examples of black colorants include carbon black; and materials that are colored black through use of yellow colorants, magenta colorants and cyan colorants. The colorant may be a single pigment, but using a colorant obtained by combining a dye and a pigment and improving the clarity is more preferred from the perspective of full color image quality.

Examples of pigments for magenta toners include those listed below. C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269 and 282; C. I. Pigment Violet 19; and C. I. Vat Red 1, 2, 10, 13, 15, 23, 29 and 35.

Examples of dyes for magenta toners include those listed below. Oil-soluble dyes such as C. I. Solvent Red 1, 3, 8, 23, 24, 25, 27, 30, 49, 81, 82, 83, 84, 100, 109 and 121; C. I. Disperse Red 9; C. I. Solvent Violet 8, 13, 14, 21 and 27; and C. I. Disperse Violet 1, and basic dyes such as C. I. Basic Red 1, 2, 9, 12, 13, 14, 15, 17, 18, 22, 23, 24, 27, 29, 32, 34, 35, 36, 37, 38, 39 and 40; and C. I. Basic Violet 1, 3, 7, 10, 14, 15, 21, 25, 26, 27 and 28.

Examples of pigments for cyan toners include those listed below. C. I. Pigment Blue 2, 3, 15:2, 15:3, 15:4, 16 and 17; C. I. Vat Blue 6; C. I. Acid Blue 45, and copper phthalocyanine pigments in which 1 to 5 phthalimidomethyl groups in the phthalocyanine skeleton are substituted.

An example of a dye for a cyan toner is C. I. Solvent Blue 70.

Examples of pigments for yellow toners include those listed below. C. I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181 and 185; and C. I. Vat Yellow 1, 3 and 20.

An example of a dye for yellow toner is C. I. Solvent Yellow 162.

It is possible to use one of these colorants or a mixture thereof, and these can be used in the form of solid solutions. These colorants are selected in view of hue angle, chroma, lightness, lightfastness, OHP transparency and dispersibility in the toner.

The content of the colorant is preferably from 0.1 parts by mass to 30.0 parts by mass relative to a total of 100 parts by mass of the resin 1 and the resin 2.

<Inorganic Fine Particles>

The toner may contain inorganic fine particles if necessary.

The inorganic fine particles may be internally added to the toner particle or mixed as an external additive with the toner particle. In cases where inorganic fine particles are contained, the elastic body of the core of a toner particle acts as a cushioning agent, as mentioned above, meaning that inorganic fine particles that were present as spacers at toner particle surfaces are unlikely to become embedded and excellent transferability can be achieved.

Inorganic fine particles such as silica, titanium oxide or aluminum oxide are preferred as the external additive. These inorganic fine particles are preferably hydrophobized by means of a hydrophobizing agent such as a silane compound, a silicone oil or a mixture of these.

Inorganic fine particles having a specific surface area of from 50 $m^2/g$ to 400 $m^2/g$ are preferred as an external additive for improving flowability, and inorganic particles having a specific surface area of from 10 $m^2/g$ to 50 $m^2/g$ are preferred in order to achieve durable stability. In order to achieve both improved flowability and durable stability, it is possible to use a combination of types of inorganic fine particle whose specific surface areas fall within the ranges mentioned above.

The content of the inorganic fine particle as an external additive is preferably from 0.1 parts by mass to 10.0 parts by mass relative to 100 parts by mass of the toner particles. When mixing the toner particles with the external additive, a publicly known mixer such as a HENSCHEL mixer may be used.

<Developer>

The toner can also be used as a single component developer, but from the perspective of further improving dot reproducibility and providing stable images over a long period of time, the toner can be used as a two component developer that is mixed with a magnetic carrier.

The magnetic carrier can be an ordinary publicly known carrier, such as iron oxide; particles of a metal such as iron, lithium, calcium, magnesium, nickel, copper, zinc, cobalt, manganese, chromium or a rare earth element, or particles of alloys or oxides of these metals; a magnetic body such as ferrite; or a magnetic body-dispersed resin carrier (a so-called resin carrier) that contains a magnetic body and a binder resin that holds the magnetic body in a dispersed state.

In cases where the toner is used as a two component developer that is mixed with a magnetic carrier, the blending proportion of the magnetic carrier in the two component developer is such that the concentration of the toner in the two component developer is preferably from 2 mass % to 15 mass %, and more preferably from 4 mass % to 13 mass %.

<Toner Production Method>

The method for producing the toner particle is not particularly limited, with an arbitrary method able to be used, but the toner particle is preferably produced in an aqueous medium. The reason for this is that by producing the toner particle in an aqueous medium, in cases where an olefin-based copolymer containing a carboxyl group-containing acid group is contained, the olefin-based copolymer containing a carboxyl group-containing acid group readily aligns at the toner particle surface, meaning that the effect of improving adhesion to paper is great.

Furthermore, an emulsion aggregation type toner produced using the emulsion aggregation method described below is more preferred. This is because in addition to production of a core-shell structure being easy, particle size control is facilitated and production of toner particles having a sharp particle size distribution is facilitated.

<Emulsion Aggregation Method>

An emulsion aggregation method is a method in which toner is produced by first preparing an aqueous dispersion liquid of fine particles which comprise the constituent materials of the toner and which are substantially smaller than the desired particle diameter, and then aggregating these fine particles in an aqueous medium until the particle diameter of the toner is reached, and then heating so as to cause melt adhesion of the resin.

That is, in an emulsion aggregation method, it is preferable to carry out a dispersion step of producing fine particle-dispersed solutions containing constituent materials of the toner, an aggregation step of aggregating fine particles comprising the constituent materials of the toner so as to control the particle diameter until the particle diameter of the toner is reached and obtain aggregated particles, a fusion step of subjecting the resin contained in the obtained aggregated particles to melt adhesion and, if necessary, a cooling step thereafter, a filtering/washing step of filtering the obtained toner and washing with ion exchanged water or the like, and a step of removing water from the washed toner and drying.

In the emulsion aggregation method, an organic solvent contact step and a separation step may be used. The organic solvent contact step and the separation step correspond to a step of treating a wet cake of the toner obtained in the filtering/washing step with an organic solvent or a step of treating the toner ultimately obtained in the drying step with an organic solvent.

<Dispersion Step>

<Resin Fine Particle-Dispersed Solution>

A resin fine particle-dispersed solution, such as a fine particle-dispersed solution of the resin 1 that forms the core or a fine particle-dispersed solution of the resin 2 that forms the shell, can be prepared using a publicly known method, but is not limited to a publicly known method. For example, it is possible to use an emulsion polymerization method, a self-emulsification method, a phase inversion emulsification method in which an aqueous medium is added to a resin solution dissolved in an organic solvent so as to emulsify the resin, or a forcible emulsification method in which a resin is subjected to a high temperature treatment in an aqueous medium without using an organic solvent so as to forcibly emulsify the resin.

Specifically, the resins are dissolved in organic solvents in which the resins dissolve, and a surfactant or basic compound is added if necessary. In such cases, if the resin is a crystalline resin having a melting point, the resin could be dissolved after being heated to at least the melting point. Next, resin fine particles are precipitated by slowly adding an aqueous medium while agitating by means of a homogenizer or the like. A resin fine particle-dispersed aqueous solution is then prepared by heating or lowering the pressure so as to remove the solvent.

Here, organic solvents used to dissolve the ester group-containing olefin-based copolymer and the olefin-based copolymer containing a carboxyl group-containing acid group can be any organic solvents able to dissolve these copolymers, but use of an organic solvent that forms a homogeneous phase with water, such as toluene, is preferred from the perspective of suppressing the generation of coarse particles.

The type of surfactant able to be used in the dispersion step is not particularly limited, but examples thereof include anionic surfactants such as sulfate ester salts, sulfonic acid salts, carboxylic acid salts, phosphate esters and soaps; cationic surfactants such as amine salts and quaternary ammonium salts; and non-ionic surfactants such as polyethylene glycol types, adducts of ethylene oxide to alkylphenols, and polyhydric alcohol types. It is possible to use one of these surfactants in isolation, or a combination of two or more types thereof.

Examples of the basic compound able to be used in the dispersion step include inorganic bases such as sodium hydroxide, potassium hydroxide and ammonia, and organic bases such as triethylamine, trimethylamine, dimethylaminoethanol and diethylaminoethanol. It is possible to use one of these basic compounds in isolation, or a combination of two or more types thereof.

In addition, the dispersed particle diameter of resin fine particles in the dispersed aqueous solution is preferably such that the 50% particle diameter on a volume basis (D50) is 0.05 μm to 1.0 μm, and more preferably 0.05 μm to 0.4 μm, from the perspective of easily obtaining toner particles having a preferred volume average particle diameter of from 3 μm to 10 μm. Moreover, a dynamic light scattering particle size distribution analyzer (Nanotrac UPA-EX150 available from Nikkiso Co., Ltd.) was used to measure the 50% particle diameter on a volume basis (D50).

<Colorant Fine Particle-Dispersed Solution>

A colorant fine particle-dispersed solution, which is used according to need, can be prepared using the publicly known method given below, but is not limited to this publicly known method.

The colorant fine particle-dispersed solution can be prepared by mixing a colorant, an aqueous medium and a dispersing agent using a publicly known mixing machine such as a stirring machine, an emulsifying machine or a dispersing machine. It is possible to use a publicly known dispersing agent such as a surfactant or a polymer dispersing agent as the dispersing agent used in this case.

Whether the dispersing agent is a surfactant or a polymer dispersing agent, the dispersing agent can be removed by means of the washing step described below, but a surfactant is preferred from the perspective of washing efficiency.

Examples of the surfactant include anionic surfactants such as sulfate ester salts, sulfonic acid salts, phosphate esters and soaps; cationic surfactants such as amine salts and quaternary ammonium salts; and non-ionic surfactants such as polyethylene glycol types, adducts of ethylene oxide to alkylphenols, and polyhydric alcohol types.

Of these, non-ionic surfactants and anionic surfactants are preferred. In addition, it is possible to use a combination of a non-ionic surfactant and an anionic surfactant. It is possible to use one of these surfactants in isolation, or a combination of two or more types thereof. The concentration of the surfactant in the aqueous medium could be 0.5 mass % to 5 mass %.

The content of colorant fine particles in the colorant fine particle-dispersed solution is not particularly limited, but is preferably 1 mass % to 30 mass % relative to the total mass of the colorant fine particle-dispersed solution.

In addition, the dispersed particle diameter of colorant fine particles in the aqueous dispersed solution is preferably such that the 50% particle diameter on a volume basis (D50) is not more than 0.5 μm from the perspective of dispersibility of the colorant in the ultimately obtained toner. In addition, for similar reasons, the 90% particle diameter on a volume basis (D90) is preferably not more than 2 μm. Moreover, the dispersed particle diameter of colorant fine particles in the aqueous dispersed solution is measured using a dynamic light scattering particle size distribution analyzer (Nanotrac UPA-EX150 available from Nikkiso Co., Ltd.).

Examples of publicly known mixing machines such as stirring machines, emulsifying machines and dispersing machines used when dispersing the colorant in the aqueous medium include ultrasonic homogenizers, jet mills, pressurized homogenizers, colloid mills, ball mills, sand mills and paint shakers. It is possible to use one of these mixing machines in isolation, or a combination thereof.

<Plasticizer (Aliphatic Hydrocarbon Compound) Fine Particle-Dispersed Solution>

A plasticizer (aliphatic hydrocarbon compound) fine particle-dispersed solution may be used if necessary. The plasticizer fine particle-dispersed solution can be prepared using the publicly known method given below, but is not limited to this publicly known method.

The plasticizer fine particle-dispersed solution can be prepared by adding a plasticizer to an aqueous medium containing a surfactant, heating to a temperature that is not lower than the melting point of the plasticizer, dispersing in a particulate state using a homogenizer having a strong shearing capacity (for example, a "Clearmix W-Motion" available from M Technique Co., Ltd.) or a pressure discharge type dispersing machine (for example, a "Gaulin homogenizer" available from Gaulin), and then cooling to lower than the melting point of the plasticizer.

The 50% particle diameter on a volume basis (D50) of plasticizer fine particles in the aqueous dispersed solution is preferably 0.03 μm to 1.0 μm, and more preferably 0.1 μm to 0.5 μm. In addition, it is preferable for coarse particles having diameters of at least 1 μm not to be present.

If the dispersed particle diameter of plasticizer fine particles falls within the range mentioned above, the plasticizer can be finely dispersed in toner particles, a plasticizing effect can be exhibited to the maximum extent during fixing, and good low-temperature fixing can be achieved. Moreover, the dispersed particle diameter of plasticizer particles dispersed in the aqueous medium is measured using a dynamic light scattering particle size distribution analyzer (Nanotrac UPA-EX150 available from Nikkiso Co., Ltd.).

<Silicone Oil Fine Particle-Dispersed Solution>

A silicone oil fine particle-dispersed solution may be used in the present invention. The silicone oil fine particle-dispersed solution may be prepared by preparing a silicone oil fine particle individually, but may also be prepared as a complex fine particle-dispersed solution obtained by mixing a silicone oil with the resin 1 that forms the core. By forming complex fine particles, it is possible to increase the content of silicone oil in a toner particle and enable the amount of silicone oil at a toner particle surface to fall within an appropriate range, thereby improving transfer efficiency.

Specifically, the silicone oil could be mixed with a solution obtained by dissolving the resin in an organic solvent in the step in which the resin fine particle-dispersed solution is prepared.

In addition, the silicone oil fine particle-dispersed solution can be prepared using the publicly known method given below, but is not limited to this publicly known method.

The silicone oil fine particle-dispersed solution can be prepared by mixing a silicone oil, an aqueous medium and a dispersing agent using a publicly known mixing machine such as a stirring machine, an emulsifying machine or a dispersing machine. It is possible to use a publicly known dispersing agent such as a surfactant or a polymer dispersing agent as the dispersing agent used in this case.

Whether the dispersing agent is a surfactant or a polymer dispersing agent, the dispersing agent can be removed by means of the washing step described below, but a surfactant is preferred from the perspective of washing efficiency.

Examples of the surfactant include anionic surfactants such as sulfate ester salts, sulfonic acid salts, phosphate esters and soaps; cationic surfactants such as amine salts and quaternary ammonium salts; and non-ionic surfactants such as polyethylene glycol types, adducts of ethylene oxide to alkylphenols, and polyhydric alcohol types.

Of these, non-ionic surfactants and anionic surfactants are preferred. In addition, it is possible to use a combination of a non-ionic surfactant and an anionic surfactant. It is possible to use one of these surfactants in isolation, or a combination of two or more types thereof. The concentration of the surfactant in the aqueous medium is preferably 0.5 mass % to 5 mass %.

The content of silicone oil fine particles in the silicone oil fine particle-dispersed solution is not particularly limited, but is preferably 1 mass % to 30 mass % relative to the total mass of the silicone oil fine particle-dispersed solution.

In addition, from the perspective of easily controlling the amount of silicone oil at a toner particle surface, the 50% particle diameter on a volume basis (D50) of the silicone oil in the aqueous dispersed solution is preferably not more than 0.5 In addition, for similar reasons, the 90% particle diameter on a volume basis (D90) is preferably not more than 2.0 μm. Moreover, the dispersed particle diameter of silicone oil fine particles in the aqueous medium can be measured using a dynamic light scattering particle size distribution analyzer (Nanotrac available from Nikkiso Co., Ltd.).

Examples of publicly known mixing machines such as stirring machines, emulsifying machines and dispersing machines used when dispersing the silicone oil in the aqueous medium include ultrasonic homogenizers, jet mills, pressurized homogenizers, colloid mills, ball mills, sand mills and paint shakers. It is possible to use one of these mixing machines in isolation, or a combination thereof.

<Mixing Step>

In the mixing step, a mixed solution is prepared by mixing the fine particle-dispersed solution of the resin 1 that forms the core and, if necessary, the plasticizer fine particle-dispersed solution, the silicone compound fine particle-dispersed solution and the colorant fine particle-dispersed solution. It is possible to use a publicly known mixing apparatus, such as a homogenizer or a mixer.

<Aggregation Step>

In the aggregation step, fine particles contained in the mixed solution prepared in the mixing step are aggregated so as to form aggregates having the target particle diameter. Here, by adding and mixing a flocculant and applying at least one of heat and a mechanical force as appropriate according to need, aggregates are formed due to resin fine particles and, if necessary, plasticizer fine particles, silicone compound fine particles and colorant fine particles aggregating. In cases where a core-shell structure is formed, it is preferable to use a method comprising mixing and aggregating components other than the fine particle-dispersed solution of the resin 2, and then add and aggregate the fine particle-dispersed solution of the resin 2.

It is preferable to use a flocculant that contains a divalent or higher metal ion as the flocculant.

A flocculant that contains a divalent or higher metal ion exhibits high cohesive strength and can achieve the desired objective even when added in a small amount. These flocculants can ionically neutralize ionic surfactants contained in the resin fine particle-dispersed solution. As a result, it is possible to aggregate resin fine particles, plasticizer fine particles, silicone compound fine particles and colorant fine particles as a result of salting out and ionic crosslinking.

Examples of flocculants containing divalent or higher metal ions include divalent or higher metal salts and metal salt polymers. Specific examples include divalent inorganic metal salts such as calcium chloride, calcium nitrate, magnesium chloride, magnesium sulfate and zinc chloride. Other examples include trivalent metal salts such as iron (III) chloride, iron (III) sulfate, aluminum sulfate and aluminum chloride. Other examples include inorganic metal salt polymers such as polyaluminum chloride, polyaluminum hydroxide and calcium polysulfide, but the flocculant is not limited to these. It is possible to use one of these in isolation, or a combination of two or more types thereof.

The flocculant may be added in the form of a dry powder or an aqueous solution dissolved in an aqueous medium, but adding the flocculant in the form of an aqueous solution is preferred in order to bring about uniform aggregation.

In addition, it is preferable for the flocculant to be added and mixed at a temperature that is not higher than the glass transition temperature or melting point of the resin contained in the mixed solution. By mixing under these temperature conditions, aggregation progresses relatively uniformly. When mixing the flocculant in the mixed solution, it is possible to use a publicly known mixing apparatus, such as a homogenizer or a mixer. The aggregation step is a step in which toner particle-sized aggregates are formed in the aqueous medium. The 50% particle diameter on a volume basis (D50) of the aggregates produced in the aggregation step is preferably from 3 μm to 10 μM.

<Fusion Step>

In the fusion step, an aggregation-stopping agent is added to a dispersed solution containing the aggregates obtained in the aggregation step while agitating in the same way as in the aggregation step. Examples of aggregation-stopping agents include basic compounds which shift the equilibrium of acidic polar groups in the surfactant to the dissociation side and stabilize aggregated particles. Other examples include chelating agents, which partially dissociate ionic crosslinks between acidic polar groups in the surfactant and metal ions which are the flocculent and form coordination bonds with the metal ions, thereby stabilizing aggregated particles. Of these, chelating agents are preferred due to exhibiting a greater aggregation-stopping effect.

After the dispersed state of aggregated particles in the dispersed solution has stabilized as a result of the action of the aggregation-stopping agent, the aggregated particles are fused by being heated to a temperature that is not lower than the glass transition temperature or melting point of the binder resin.

The chelating agent is not particularly limited as long as a publicly known water-soluble chelating agent is used. Specific examples thereof include oxycarboxylic acids, such as tartaric acid, citric acid and gluconic acid, and sodium salts of these; iminodiacetic acid (IDA), nitrilotriacetic acid (NTA), ethylenediaminetetraacetic acid (EDTA) and sodium salts of these.

By coordinating to a metal ion in the flocculent present in the dispersed solution of aggregated particles, the chelating agent can change the environment in this dispersed solution from a state which is electrostatically unstable and in which aggregation readily occurs to a state which is electrostatically stable and in which aggregation is unlikely to occur. Due to this configuration, it is possible to suppress further aggregation of aggregated particles in the dispersed solution, stabilize the aggregated particles and obtain toner particles.

The chelating agent is preferably an organic metal salt having a trivalent or higher carboxylic acid from the perspectives of exhibiting an effect even when added in a small amount and enabling toner particles having a sharp particle size distribution to be obtained.

In addition, the added quantity of the chelating agent is preferably 1 part by mass to 30 parts by mass, and more preferably 2.5 parts by mass to 15 parts by mass, relative to a total of 100 parts by mass of the resins 1 and 2 from the perspective of achieving both stabilization from an aggregated state and washing efficiency. Moreover, the 50% particle diameter on a volume basis (D50) of the toner particles is preferably from 3 μm to 10 μm.

<Cooling Step>

The cooling step is a step in which the dispersed solution containing toner particles obtained in the fusion step is cooled to a temperature that is lower than the crystallization temperature and glass transition temperature of the resins 1 and 2. By cooling to this temperature, it is possible to suppress generation of coarse particles. A specific cooling rate is 0.1° C./min to 50° C./min.

<Washing Step>

In the washing step, the toner particles obtained in the cooling step are repeatedly washed and filtered so as to remove impurities in the toner particles. Specifically, it is preferable to wash the toner particles using an aqueous solution containing a chelating agent such as ethylenediaminetetraacetic acid (EDTA) or a sodium salt thereof, and then with pure water. By repeatedly washing with pure water and filtering, it is possible to remove metal salts, surfactants, and the like, in the toner particles. From the perspective of production efficiency, the number of times the toner particles are filtered is preferably 3 to 20, and more preferably 3 to 10.

<Organic Solvent Contact Step and Separation Step>

In the organic solvent contact step and separation step, the toner particles obtained in the washing step may, if necessary, be brought into contact with an organic solvent and separated, thereby washing out low molecular weight silicone compounds having high affinity for organic solvents and enabling a thin film of a silicone compound having a sharp molecular weight distribution to be formed on the surface of toner particles. Unlike solvents such as those used to wash conventional release agents, the organic solvent to be used is preferably an organic solvent having at least a certain degree of affinity for silicone compounds. If the affinity is too high, the silicone compound that is the release agent may be excessively extracted from the toner particle. Specific examples of the organic solvent include ethanol, methanol, propanol, isopropanol, ethyl acetate, methyl acetate, butyl acetate and mixtures of these.

The organic solvent may contain water, and the water content is preferably from 0 parts by mass to 10 parts by mass relative to 100 parts by mass of the organic solvent. By making the water content not more than 10 parts by mass, it is possible to remove low molecular weight silicone compounds in the vicinity of the toner particle surface.

The treatment time in the step of bringing the toner particles into contact with an organic solvent is preferably from 1 minute to 60 minutes.

In the step of bringing the toner particles into contact with an organic solvent, in cases where an organic solvent dispersed solution of toner particles is obtained by mixing the toner particles with the organic solvent, agitation may be carried out using a stirring blade or by means of a homogenizer, an ultrasonic disperser, or the like, but from the perspective of uniformly treating the toner particles, it is preferable to carry out an agitation treatment using a homogenizer, an ultrasonic disperser, or the like.

The step of separating the toner particles from the organic solvent is a step in which the organic solvent dispersed solution of toner particles obtained in the contact step or a mixture of a toner wet cake and the organic solvent are physically separated by means of filtration or the like. If it is possible to separate the toner particles and the organic solvent, the method is not particularly limited, but examples thereof include suction filtration, pressure filtration and centrifugal separation.

The step for bringing toner particles into contact with an organic solvent and the separation step may be carried out a plurality of times. In particular, in cases where a mixture of a toner wet cake and an organic solvent is treated, the removal rate of silicone compounds may be lowered if water is present in the toner wet cake, meaning that the treatment is more preferably carried out a plurality of times.

<Drying Step>

In the drying step, the toner particles obtained in the steps mentioned above are dried.

<External Addition Step>

In the external addition step, inorganic fine particles are, if necessary, externally added to the toner particles obtained in the drying step. Specifically, it is preferable to add inorganic fine particles such as silica, alumina, titania or calcium carbonate or resin fine particles such as a vinyl resin, a polyester resin or a silicone resin while applying a shearing force in a dry state.

Explanations will now be given of methods for measuring a variety of physical properties of the toner and raw materials.

<Methods for Measuring Loss Tangent (tan $\delta_{1(70° C.-90° C.)}$ and tan $\delta_{1(70° C.-90° C.)}$) of the Resin 1 that Forms the Core and the Resin 2 that Forms the Shell by Means of Dynamic Viscoelasticity Tests>

Dynamic viscoelasticity is measured using an "ARES" rotating plate rheometer (available from TA Instruments).

A sample obtained by pressure molding a toner (1 g) into the shape of a disk having a diameter of 25 mm and a thickness of 2.0±0.3 mm using a tablet molding machine in an atmosphere having a temperature of 25° C. is used as a measurement sample.

The sample is disposed between parallel plates, the temperature is increased from room temperature (25° C.) to 110° C. over a period of 15 minutes, the shape of the sample is adjusted, the sample is then cooled to the viscoelasticity measurement start temperature, and measurements are then started. Here, it is important that the sample is set in such a way that the initial normal force is 0. In addition, by adjusting the automatic tension (to Auto Tension Adjustment ON), it is possible to cancel out effects of normal forces in subsequent measurements, as explained below.

The measurements are carried out under the following conditions.

(1) Parallel plates having diameters of 25 mm are used.

(2) The frequency is 6.28 rad/sec (1.0 Hz).

(3) The initial applied strain is set to 1.0%.

(4) Within the range 40° C. to 200° C., measurements are carried out at a ramp rate of 2.0° C./min. Moreover, measurements are carried out under the following preset conditions for automatic adjustment mode. Measurements are carried out under Auto Strain mode.

(5) The Max Applied Strain is set to 40.0%.

(6) The Max Allowed Torque is set to 150.0 g·cm, and the Min Allowed Torque is set to 0.2 g·cm.

(7) Strain Adjustment is set to 20.0% of Current Strain. Auto Tension mode is used for the measurements.

(8) Auto Tension Direction is set to Compression.

(9) Initial Static Force is set to 10.0 g, and Auto Tension Sensitivity is set to 40.0 g.

(10) Auto Tension operation conditions are a sample modulus of at least $1.0\times10^3$ Pa.

<Method for Measuring Ester Group Concentration in Ester Group-Containing Olefin-Based Copolymer>

The ester group concentration in the ester group-containing olefin-based copolymer is measured using $^1$H NMR. Under the conditions mentioned below, the integration ratios of hydrogen in alkenyl groups in formula (1), hydrogen in acetyl groups or propionyl groups in formula (2) and hydrogen in oxygen-bonded methyl groups or ethyl groups in formula (3) are measured, and by comparing these, the proportions of the units can be calculated. By inputting the thus obtained unit proportions into the formula below, the ester group concentration can be calculated.

$$\text{Ester group concentration (units: mass \%)} = [(N\times44)/\text{number average molecular weight}]\times100$$

Here, N is the average number of ester groups per molecule of the ester group-containing olefin-based copolymer, and 44 is the formula weight of an ester group [—C(═O)O—].

Apparatus: JNM-ECZR series FT NMR (available from JEOL Ltd.)

Solvent: 5 mL of deuterated acetone (tetramethylsilane is contained as an internal standard having a chemical shift of 0.00 ppm)

Sample: 5 mg

Repetition time: 2.7 seconds

Number of accumulations: 16

For example, because the peak at 1.14 to 1.36 ppm corresponds to $CH_2$—$CH_2$ in ethylene units and the peak at approximately 2.04 ppm corresponds to $CH_3$ in vinyl acetate units, the proportions of units in the ester group-containing olefin-based copolymer 1 (an ethylene-vinyl acetate copolymer) used in Example 1 were calculated by calculating the ratio of the integrated values of these peaks.

(Measurements Carried Out from Toner)

Measurements are carried out after separating the ester group-containing olefin-based copolymer from the toner by utilizing different solubilities in solvents.

The ester group-containing olefin-based copolymer is separated from the toner using the following procedure.

First separation: The toner is dissolved in MEK at 23° C., and the soluble (the amorphous resin) is separated from insoluble components (the ester group-containing olefin-based copolymer and olefin-based copolymer containing a carboxyl group-containing acid group, and the release agent, colorant, inorganic fine particles, and the like, which are added according to need).

Second separation: The insoluble components obtained by means of the first separation (the ester group-containing olefin-based copolymer, olefin-based copolymer containing a carboxyl group-containing acid group, release agent, colorant and inorganic particles) are dissolved in toluene at 50° C., and the soluble components (the ester group-containing olefin-based copolymer and olefin-based copolymer containing a carboxyl group-containing acid group) are separated from the insoluble components (the release agent, colorant and inorganic fine particles).

Third separation: The soluble components obtained by means of the second separation (the ester group-containing olefin-based copolymer and olefin-based copolymer containing a carboxyl group-containing acid group) are dissolved in THF at 40° C., and the soluble component (the ester group-containing olefin-based copolymer) is separated from the insoluble component (the olefin-based copolymer containing a carboxyl group-containing acid group).

By subjecting the thus obtained soluble component (the ester group-containing olefin-based copolymer) to $^1$H NMR measurements, it is possible to measure the ester group concentration in the ester group-containing olefin-based copolymer.

<Method for Measuring Acid Value of Ester Group-Containing Olefin-Based Copolymer and Olefin-Based Copolymer Containing Carboxyl Group-Containing Acid Group>

The acid value is the number of milligrams of potassium hydroxide required to neutralize acid components such as free fatty acids and resin acids contained in 1 g of a sample. The measurement method is in accordance with JIS-K0070, as described below.

(1) Reagents

Solvent: A toluene:ethyl alcohol mixture (2:1) is neutralized with a 0.1 mol/L ethyl alcohol solution of potassium hydroxide immediately before use, and phenolphthalein is used as an indicator.

Phenolphthalein solution: 1 g of phenolphthalein is dissolved in 100 mL of (95 vol %) ethyl alcohol.

0.1 mol/L ethyl alcohol solution of potassium hydroxide: 7.0 g of potassium hydroxide is dissolved in as little water as possible, (95 vol %) ethyl alcohol is added up to 1 L, and this is then left to stand for 2 to 3 days and then filtered. Measurements are carried out in accordance with JIS K 8006 (Basic matters concerning titration during a reagent content test).

(2) Operation

From 1 g to 20 g of the resin is accurately weighed out as a sample, 100 mL of the solvent and a few drops of the phenolphthalein solution as an indicator are added to the sample, and vigorous shaking is carried out until the sample completely dissolves. In the case of a solid sample, the sample is dissolved by heating over a water bath. After cooling, this is titrated with the 0.1 mol/L ethyl alcohol solution of potassium hydroxide, and the neutralization end point is deemed to be the point at which the pale red color of the indicator remains for 30 seconds.

(3) Calculation Formula

Acid value is calculated using the following formula.

$$A=B\times f\times 5.611/S$$

A: Acid value (mg KOH/g)

B: Usage amount (mL) of 0.1 mol/L ethyl alcohol solution of potassium hydroxide f: Factor of 0.1 mol/L ethyl alcohol solution of potassium hydroxide S: Sample (g)

<Method for Measuring Melting Point of Ester Group-Containing Olefin-Based Copolymer and Olefin-Based Copolymer Containing Carboxyl Group-Containing Acid Group>

The melting point of the ester group-containing olefin-based copolymer and olefin-based copolymer containing a carboxyl group-containing acid group is measured in accordance with ASTM D3418-82 using a "Q2000" differential scanning calorimeter (available from TA Instruments).

Temperature calibration of the detector in the apparatus is performed using the melting points of indium and zinc, and heat amount calibration is performed using the heat of fusion of indium.

Specifically, approximately 3 mg of a sample is precisely weighed out and placed in an aluminum pan, an empty aluminum pan is used as a reference, and measurements are carried out under the following conditions.

Ramp rate: 10° C./min

Measurement start temperature: 30° C.

Measurement end temperature: 180° C.

The peak temperature of the endothermic peak on the obtained DSC curve is the melting point.

(Separation of Ester Group-Containing Olefin-Based Copolymer and Olefin-Based Copolymer Containing Carboxyl Group-Containing Acid Group from Toner)

In the same way as in the method mentioned above, DSC measurements are carried out after separating the ester group-containing olefin-based copolymer and the olefin-based copolymer containing a carboxyl group-containing acid group from the toner by utilizing different solubilities in solvents.

<Method for Measuring Weight Average Molecular Weight (Mw) of Amorphous Resin>

The weight average molecular weight (Mw) of the amorphous resin is measured by means of gel permeation chromatography (GPC), in the manner described below.

First, the toner is dissolved in tetrahydrofuran (THF) at room temperature over a period of 24 hours. A sample solution is then obtained by filtering the obtained solution using a solvent-resistant membrane filter having a pore diameter of 0.2 μm (a "Sample Pretreatment Cartridge" available from Tosoh Corporation). Moreover, the sample solution is adjusted so that the concentration of THF-soluble components is approximately 0.1 mass %. Measurements are carried out using this sample solution under the following conditions.

Apparatus: HLC8120 GPC (detector: RI) (available from Tosoh Corporation)

Column: Combination of seven Shodex KF-801, 802, 803, 804, 805, 806 and 807 (available from Showa Denko K.K.)

Eluant: Tetrahydrofuran (THF)

Flow rate: 1.0 mL/min

Oven temperature: 40.0° C.

Injected amount: 0.10 mL

When calculating the molecular weight of the sample, a molecular weight calibration curve is prepared using standard polystyrene resins (product names "TSK Standard Polystyrene F-850, F-450, F-288, F-128, F-80, F-40, F-20, F-10, F-4, F-2, F-1, A-5000, A-2500, A-1000 and A-500", available from Tosoh Corporation).

<Method for Measuring Weight Average Molecular Weight (Mw) of Ester Group-Containing Olefin-Based Copolymer and Olefin-Based Copolymer Containing Carboxyl Group-Containing Acid Group>

The weight average molecular weight of the ester group-containing olefin-based copolymer and olefin-based copolymer containing a carboxyl group-containing acid group is measured by means of gel permeation chromatography (GPC), in the manner described below.

First, the ester group-containing olefin-based copolymer and the olefin-based copolymer containing a carboxyl group-containing acid group are dissolved in toluene at 135° C. over a period of 6 hours. A sample solution is then obtained by filtering the obtained solution using a solvent-resistant membrane filter having a pore diameter of 0.2 μm (a "Sample Pretreatment Cartridge" available from Tosoh Corporation). Moreover, the sample solution is adjusted so that the concentration of toluene-soluble components is approximately 0.1 mass %. Measurements are carried out using this sample solution under the following conditions.

Apparatus: HLC-8121 GPC/HT (available from Tosoh Corporation)

Column: 2×TSKgel GMHHR-H HT (7.8 cm I.D.×30 cm) (available from Tosoh Corporation)

Detector: High temperature RI

Temperature: 135° C.

Solvent: Toluene

Flow rate: 1.0 mL/min

Sample: 0.4 mL of a 0.1% sample is injected

When calculating the molecular weight of the sample, a molecular weight calibration curve prepared using monodispersed polystyrene standard samples is used. Furthermore, the molecular weight is calculated by converting to polyethylene using a conversion formula derived from the Mark-Houwink viscosity formula.

<Method for Measuring Softening Point (Tm) of Toner>

The softening point is measured using a constant load extrusion type capillary rheometer "Flow Tester CFT-500D Flow Characteristics Analyzer" (available from Shimadzu Corporation), with the measurements being carried out in accordance with the manual provided with the apparatus.

In this apparatus, the temperature of a measurement sample filled in a cylinder is increased while a constant load is applied from above by means of a piston, thereby melting the sample, the molten measurement sample is extruded through a die at the bottom of the cylinder, and a flow curve can be obtained from the amount of piston travel and the temperature during this process.

In the present invention, the softening point was taken to be the "melting temperature by the half method" described in the manual provided with the "Flow Tester CFT-500D Flow Characteristics Analyzer".

Moreover, the melting temperature by the half method is calculated as follows.

First, half of the difference between the amount of piston travel at the completion of outflow (Smax) and the amount of piston travel at the start of outflow (Smin) is determined (This is designated as X. X=(Smax−Smin)/2). Next, the temperature in the flow curve when the amount of piston travel reaches the sum of X and Smin is taken to be the melting temperature by the half method.

The measurement sample is prepared by subjecting approximately 1.0 g of a sample to compression molding for approximately 60 seconds at approximately 10 MPa in a 25° C. environment using a tablet compression molder (for example, a Standard Manual Newton Press NT-100H available from NPa System Co., Ltd.) to provide a cylindrical shape with a diameter of approximately 8 mm.

The measurement conditions for the Flow Tester CFT-500D are as follows.

Test mode: Rising temperature method
Start temperature: 50° C.
End point temperature: 200° C.
Measurement interval: 1.0° C.
Ramp rate: 4.0° C./min
Piston cross section area: 1.000 $cm^2$
Test load (piston load): 10.0 kgf (0.9807 MPa)
Preheating time: 300 sec
Diameter of die orifice: 1.0 mm
Die length: 1.0 mm <Method for Measuring Weight-average Particle Diameter (D4) of Toner>

The weight-average particle diameter (D4) of the toner is calculated by carrying out measurements using a precision particle size distribution measuring device which employees a pore electrical resistance method and uses a 100 μm aperture tube ("Coulter Counter Multisizer 3" (registered trademark) available from Beckman Coulter, Inc.) and accompanying dedicated software that is used to set measurement conditions and analyze measured data ("Beckman Coulter Multisizer 3 Version 3.51" produced by Beckman Coulter, Inc.) (number of effective measurement channels: 25,000), and then analyzing the measurement data.

A solution obtained by dissolving special grade sodium chloride in ion exchanged water at a concentration of approximately 1 mass %, such as "ISOTON II" (produced by Beckman Coulter, Inc.), can be used as an aqueous electrolyte solution used in the measurements.

Moreover, dedicated software was set up as follows before carrying out measurements and analysis.

On the "Standard Operating Method (SOM) alteration screen" in the dedicated software, the total count number in control mode is set to 50,000 particles, the number of measurements is set to 1, and the Kd value is set to value obtained by "standard particle 10.0 μm" (Beckman Coulter, Inc.). By pressing the threshold value/noise level measurement button, threshold values and noise levels are automatically set. In addition, the current is set to 1600 μA, the gain is set to 2, the electrolyte solution is set to ISOTON II, and the "Flush aperture tube after measurement" option is checked.

On the "Screen for setting conversion from pulse to particle diameter" in the dedicated software, the bin interval is set to logarithmic particle diameter, the particle diameter bin is set to 256 particle diameter bin, and the particle diameter range is set to from 2 μm to 60 μm.

The specific measurement method is as follows.

(1) 200 mL of the aqueous electrolyte solution is placed in a 250 mL glass round bottomed beaker dedicated to Multisizer 3, the beaker is set on a sample stand, and a stirring rod is rotated anticlockwise at a rate of 24 rotations/second. By carrying out the "Aperture tube flush" function of the dedicated software, dirt and bubbles in the aperture tube are removed.

(2) 30 mL of the aqueous electrolyte solution is placed in a 100 mL glass flat bottomed beaker, and approximately 0.3 mL of a diluted liquid, which is obtained by diluting "Contaminon N" (a 10 mass % aqueous solution of a neutral detergent for cleaning precision measurement equipment, which has a pH of 7 and comprises a non-ionic surfactant, an anionic surfactant and an organic builder, available from Wako Pure Chemical Industries, Ltd.) 3-fold with ion exchanged water, is added to the beaker as a dispersant.

(3) A prescribed amount of ion exchanged water is placed in a water bath of an "Ultrasonic Dispersion System Tetora 150" (available from Nikkaki Bios Co., Ltd.) having an electrical output of 120 W, in which two oscillators having an oscillation frequency of 50 kHz are housed so that their phases are staggered by 180°, and approximately 2 mL of the Contaminon N is added to the water bath.

(4) The beaker mentioned in section (2) above is placed in a beaker-fixing hole of the ultrasonic wave disperser, and the ultrasonic wave disperser is activated. The height of the beaker is adjusted so that the resonant state of the liquid surface of the aqueous electrolyte solution in the beaker is at a maximum.

(5) While the aqueous electrolyte solution in the beaker mentioned in section (4) above is being irradiated with ultrasonic waves, approximately 10 mg of toner is added a little at a time to the aqueous electrolyte solution and dispersed therein. The ultrasonic wave dispersion treatment is continued for a further 60 seconds. Moreover, when carrying out the ultrasonic wave dispersion, the temperature of the water bath is adjusted as appropriate to a temperature of from 10° C. to 40° C.

(6) The aqueous electrolyte solution mentioned in section (5) above, in which the toner is dispersed, is added dropwise by means of a pipette to the round bottomed beaker mentioned in section (1) above, which is disposed on the sample stand, and the measurement concentration is adjusted to approximately 5%. Measurements are carried out until the number of particles measured reaches 50,000.

(7) The weight-average particle diameter (D4) is calculated by analyzing measurement data using the accompanying dedicated software. Moreover, when setting the graph/vol. % with the dedicated software, the "average diameter" on the analysis/volume-based statistical values (arithmetic mean) screen is weight-average particle diameter (D4).

<Method for Measuring Average Circularity of Toner>

The average circularity of the toner is measured when carrying out calibration work using a flow particle image analyzer (a "FPIA-3000" available from Sysmex Corporation), and measured under analysis conditions.

The measurement principles of the flow particle image analyzer ("FPIA-3000" available from Sysmex Corporation) are such that images of flowing particles are taken as static images and then subjected to image analysis. A sample added to a sample chamber is transported to a flat sheath flow cell using a sample suction syringe. The sample transported in the flat sheath flow is held by a sheath liquid and forms a flat flow. The sample passing through the flat sheath flow cell is irradiated with strobe light at intervals of 1/60 second, and images of flowing particles can be taken as static images. In addition, because the flow is flat, focused images are taken. Particle images are taken using a CCD camera, obtained images are processed at a resolution of 512×512 pixels (one pixel measures 0.37×0.37 μm), the particle images are subjected to contour extraction, and the projected area S and circumference L of the particle images are measured.

Next, the circle-equivalent diameter and circularity are determined from the area S and circumference L. The circle-equivalent diameter is defined as the diameter of a circle having the same area as a projected area of particle image, and the circularity C is defined as the value obtained by dividing the circumference of a circle determined from the circle-equivalent diameter by the circumference of the projected particle image, and is calculated using the following formula.

$$\text{Circularity } C=2\times(\pi\times S)^{1/2}/L$$

The circularity is 1.000 if the particle image is circular, and the circularity decreases as the degree of unevenness around the periphery of the particle image increases. After calculating the circularity values of the particles, the circularity range of from 0.200 to 1.000 is divided into 800 divisions, the arithmetic average value of the obtained circularity values is calculated, and this is deemed to be the average circularity.

The specific measurement method is as follows.

First, approximately 20 mL of ion exchanged water from which solid impurities and the like have been removed in advance is placed in a glass container. Approximately 0.2 mL of a diluted liquid, which is obtained by diluting "Contaminon N" (a 10 mass % aqueous solution of a neutral detergent for cleaning precision measurement equipment, which has a pH of 7 and comprises a non-ionic surfactant, an anionic surfactant and an organic builder, available from Wako Pure Chemical Industries, Ltd.) approximately 3-fold with deionized water, is added to the beaker as a dispersant.

Next, approximately 0.02 g of a measurement sample is added and dispersed for 2 minutes using an ultrasonic disperser so as to obtain a dispersed solution for measurement. At this point, the dispersed solution is cooled as appropriate to a temperature of from 10° C. to 40° C. A tabletop ultrasonic cleaning disperser having an oscillation frequency of 50 kHz and an electrical output of 150 W (a "VS-150" available from Velvo-Clear) is used as the ultrasonic disperser, a prescribed quantity of ion exchanged water is added to a water tank, and approximately 2 mL of Contaminon N is added to the water tank.

Measurements are carried out using the flow particle image analyzer fitted with a standard objective lens (10 times magnification), and particle sheath "PSE-900A" (available from Sysmex Corporation) is used as the sheath liquid. A dispersed solution prepared on the basis of this procedure is introduced into the flow particle image analyzer, and 3000 toner particles are measured in HPF measurement mode and total count mode.

In addition, the average circularity of the toner was determined by setting the binary threshold value to 85% when analyzing the particles and setting the diameters of analyzed particles to circle-equivalent diameters of from 1.98 μm to 39.96 μm.

When carrying out the measurements, automatic focus adjustment is carried out prior to the start of measurements using standard latex particles (for example, particles obtained by diluting "RESEARCH AND TEST PARTICLES Latex Microsphere Suspensions 5200A" available from Duke Scientific with ion exchanged water). Thereafter, it is preferable to carry out focus adjustment every 2 hours from the start of measurements.

<Method for Measuring 50% Particle Diameter on a Volume Basis (D50) of Fine Particles of Ester Group-Containing Olefin-Based Copolymer, Olefin-Based Copolymer Containing Carboxyl Group-Containing Acid Group, Amorphous Polyester Resin, Silicone Compound, Aliphatic Hydrocarbon Compound and Colorant>

The 50% particle diameter on a volume basis (D50) of fine particles of the ester group-containing olefin-based copolymer, olefin-based copolymer containing a carboxyl group-containing acid group, amorphous polyester resin, silicone compound, aliphatic hydrocarbon compound and colorant is measured using a dynamic light scattering particle size distribution analyzer (Nanotrac UPA-EX150 available from Nikkiso Co., Ltd.). In order to prevent aggregation of the measurement sample (resin fine particles), a dispersed solution obtained by dispersing the measurement sample in an aqueous solution containing Family Fresh (available from Kao Corporation) is introduced and agitated, and then introduced into the apparatus, after which measurements are carried out twice and the average value is determined.

In terms of measurement conditions, the measurement time is 30 seconds, the refractive index of sample particles is 1.49, the dispersion medium is water, and the refractive index of the dispersion medium is 1.33. The volume-based particle size distribution of the measurement sample is measured, and from the measurement results, the particle diameter at which the cumulative value from the small particle diameter side reaches 50% in the volume-based particle size distribution is calculated as the 50% particle diameter on a volume basis (D50) of the fine particles.

<Measurement of Glass Transition Temperature Tg of Resin 2 that Constitutes Shell>

The glass transition temperature Tg of the amorphous resin is measured in accordance with ASTM D3418-82 using a "Q2000" differential scanning calorimeter (available from TA Instruments).

Temperature calibration of the detector in the apparatus is performed using the melting points of indium and zinc, and heat amount calibration is performed using the heat of fusion of indium.

Specifically, approximately 3 mg of a sample is precisely weighed out and placed in an aluminum pan, an empty aluminum pan is used as a reference, and measurements are carried out under the following conditions.

Ramp rate: 10° C./min

Measurement start temperature: 30° C.

Measurement end temperature: 180° C.

The measurement range is 30° C. to 180° C., and measurements are carried out at a ramp rate of 10° C./min. The temperature is once increased to 180° C., held for 10 minutes, then lowered to 30° C., and then increased again. A change in specific heat is determined within the temperature range of from 30° C. to 100° C. in this second temperature increase step. Here, the glass transition temperature Tg of the sample is deemed to be the point at which the differential thermal analysis curve intersects with the line at an intermediate point on the baseline before and after a change in specific heat occurs.

(Separation of Amorphous Resin from Toner)

DSC measurements are carried out in the same way as the method described above, after separating the amorphous resin from the toner by utilizing different solubilities in solvents.

EXAMPLES

The present invention will now be explained in detail on the basis of examples. However, this invention is in no way limited to these examples. Moreover, number of parts in the formulations below are on a mass basis unless explicitly stated otherwise.

Production Example of Ester Group-Containing Olefin-Based Copolymer 1 ($R^1$=H, $R^2$=H, $R^3$=$CH_3$)

Polyethylene: 75.2 parts (90.3 mol % relative to the total number of moles)

Vinyl acetate: 24.8 parts (9.7 mol % relative to the total number of moles)

Isobutyl aldehyde (chain transfer agent): 4.2 parts

Di-t-butyl peroxide (radical generating catalyst): 0.0025 parts

The materials listed above were weighed out and transported to a tubular reactor using a high-pressure pump, and ester group-containing olefin-based copolymer 1 was obtained by copolymerizing polyethylene and vinyl acetate at a reaction pressure of 240 MPa and a reaction peak temperature of 250° C. The obtained ester group-containing olefin-based copolymer 1 had a weight average molecular weight (Mw) of 110,000, a melting point (Tp) of 86° C., a melt flow rate (MFR) of 12 g/10 min and an acid value (Av) of 0 mg KOH/g.

Production Examples of Ester Group-Containing Olefin-Based Copolymers 2 to 10

Ester group-containing olefin-based copolymers 2 to 10 were obtained by carrying out a similar reaction to that used in the production example of the ester group-containing olefin-based copolymer 1, except that the monomers and numbers of parts by mass were altered in the manner shown in Table 1. Physical properties are shown in Table 2.

TABLE 1

| Ester group-containing olefin-based copolymer | Monomer Type | Monomer Mass (parts) | Monomer mol (%) | Monomer Type | Monomer Mass (parts) | Monomer mol (%) | Monomer Type | Monomer Mass (parts) | Monomer mol (%) |
|---|---|---|---|---|---|---|---|---|---|
| 1 | PE | 75.2 | 90.3 | VA | 24.8 | 9.7 | | | |
| 2 | PE | 70.5 | 88.0 | VA | 29.5 | 12.0 | | | |
| 3 | PE | 78.9 | 92.0 | VA | 21.1 | 8.0 | | | |
| 4 | PE | 68.6 | 87.0 | VA | 31.4 | 13.0 | | | |
| 5 | PE | 83.6 | 94.0 | VA | 16.4 | 6.0 | | | |
| 6 | PE | 66.7 | 86.0 | VA | 33.3 | 14.0 | | | |
| 7 | PE | 94.1 | 98.0 | VA | 5.9 | 2.0 | | | |
| 8 | PE | 81.4 | 94.0 | | | | EA | 18.6 | 6.0 |
| 9 | PE | 63.1 | 84.0 | VA | 36.9 | 16.0 | | | |
| 10 | PE | 97.0 | 99.0 | VA | 3.0 | 1.0 | | | |

Abbreviations used in Table 1 are as follows.

PE: Polyethylene

VA: Vinyl acetate

EA: Ethyl acrylate

TABLE 2

| Ester group-containing olefin-based copolymer | Physical properties: Ester group concentration (%) | Mw | Tp (° C.) | MFR (g/10 min) | Av (mgKOH/g) |
|---|---|---|---|---|---|
| 1 | 12.7 | 110000 | 86 | 12 | 0 |
| 2 | 15.1 | 110000 | 71 | 18 | 0 |
| 3 | 10.8 | 110000 | 89 | 10 | 0 |
| 4 | 16.1 | 110000 | 69 | 19 | 0 |
| 5 | 8.4 | 110000 | 91 | 9 | 0 |
| 6 | 17.0 | 110000 | 67 | 20 | 0 |
| 7 | 3.0 | 110000 | 100 | 6 | 0 |
| 8 | 8.2 | 110000 | 99 | 7 | 0 |
| 9 | 18.9 | 110000 | 65 | 23 | 0 |
| 10 | 1.5 | 110000 | 101 | 5 | 0 |

Production Example of Olefin-Based Copolymer 1 Containing Carboxyl Group-Containing Acid Group Polyethylene: 86.1 parts (95.0 mol % relative to the total number of moles)

Methacrylic acid: 13.9 parts (5.0 mol % relative to the total number of moles)

Isobutyl aldehyde (chain transfer agent): 4.2 parts

Di-t-butyl peroxide (radical generating catalyst): 0.0025 parts

The materials listed above were weighed out and transported to a tubular reactor using a high-pressure pump, and olefin-based copolymer 1 containing a carboxyl group-containing acid group was obtained by copolymerizing polyethylene and methacrylic acid at a reaction pressure of 240 MPa and a reaction peak temperature of 250° C. The obtained olefin-based copolymer 1 containing a carboxyl group-containing acid group had a weight average molecular weight (Mw) of 90,000, a melting point (Tp) of 90° C., a melt flow rate (MFR) of 60 g/10 min and an acid value (Av) of 90 mg KOH/g.

Production Example of Amorphous Resin 1

Polyoxypropylene(2.2)-2,2-bis(4-hydroxyphenyl)propane: 76.3 parts (50.0 mol % relative to the total number of moles)

Terephthalic acid: 16.1 parts (30.0 mol % relative to the total number of moles)

Succinic acid: 7.6 parts (20.0 mol % relative to the total number of moles)

Titanium tetrabutoxide (esterification catalyst): 0.5 parts

The materials listed above were weighed out into a reaction vessel equipped with a condenser tube, a stirrer, a nitrogen inlet tube and a thermocouple.

Next, the reaction vessel was purged with nitrogen gas, the temperature was gradually increased while stirring the contents of the reaction vessel, and a reaction was allowed to progress for 4 hours while stirring the contents of the reaction vessel at a temperature of 200° C.

Tert-butylcatechol (polymerization inhibitor): 0.1 parts

Next, after confirming that the softening point, as measured in accordance with ASTM D36-86, had reached the prescribed temperature, amorphous resin 1 was obtained by adding the materials listed above and lowering the temperature so as to terminate the reaction.

The obtained amorphous resin 1 had a weight average molecular weight (Mw) of 9000, a softening point (Tm) of 100° C., a glass transition temperature (Tg) of 60° C. and an acid value (Av) of 5 mg KOH/g.

Production Example of Amorphous Resin 2

Amorphous resin 2 was obtained by carrying out a similar reaction to that used in the production example of amorphous resin 1, except that the monomers and numbers of parts by mass were altered in the manner shown in Table 3. Physical properties of amorphous resin 2 are shown in Table 4.

Production Example of Amorphous Resin 3

In a nitrogen atmosphere, the materials listed below were placed in a reaction vessel equipped with a reflux condenser, a stirrer and a nitrogen inlet tube.

Styrene (St): 79.1 parts

Toluene (Tol1): 100 parts n-butyl acrylate (BA): 8.5 parts

Methyl methacrylate (MMA): 12.4 parts di-t-butyl peroxide (PBD): 7.2 parts

The contents of the vessel were stirred at a speed of 200 rpm, heated to 110° C., and stirred for 10 hours. The temperature was then increased to 140° C., and polymerization was carried out for 6 hours. Amorphous resin 3 was obtained by distilling off the solvent.

Production Examples of Amorphous Resins 4 to 7

Amorphous resins 4 to 7 were obtained by carrying out a similar reaction to that used in the production example of amorphous resin 3, except that the monomers and numbers of parts by mass were altered in the manner shown in Table 3. Physical properties are shown in Table 4.

TABLE 3

| Amorphous resin | Monomer Type | Monomer Mass (parts) | Monomer mol (%) | Monomer Type | Monomer Mass (parts) | Monomer mol (%) | Monomer Type | Monomer Mass (parts) | Monomer mol (%) |
|---|---|---|---|---|---|---|---|---|---|
| 1 | BPA-PO | 76.3 | 50.0 | TPA | 16.1 | 30.0 | SUS | 7.6 | 20.0 |
| 2 | BPA-PO | 76.3 | 50.0 | TPA | 16.1 | 30.0 | SUS | 7.6 | 20.0 |
| 3 | ST | 79.1 | 80.0 | MMA | 12.4 | 13.0 | BA | 8.5 | 7.0 |
| 4 | ST | 79.5 | 80.0 | MMA | 14.3 | 15.0 | BA | 6.1 | 5.0 |
| 5 | ST | 78.1 | 80.0 | MMA | 7.5 | 8.0 | BA | 14.4 | 12.0 |
| 6 | ST | 80.0 | 80.0 | MMA | 16.3 | 17.0 | BA | 3.7 | 3.0 |
| 7 | ST | 77.7 | 80.0 | MMA | 5.6 | 6.0 | BA | 16.7 | 14.0 |

Abbreviations used in Table 3 are as follows.

BPA-PO: Polyoxypropylene(2.2)-2,2-bis(4-hydroxyphenyl) propane

TPA: Terephthalic acid

SUS: Fumaric acid

ST: Styrene

MMA: Methyl methacrylate

BA: Butyl acrylate

TABLE 4

| Amorphous resin | Mw | Tm (° C.) | Tg (° C.) | Av (mgKOH/g) |
|---|---|---|---|---|
| 1 | 9000 | 100 | 60 | 5 |
| 2 | 110000 | 110 | 67 | 4 |
| 3 | 110000 | 110 | 67 | 0 |
| 4 | 110000 | 110 | 70 | 0 |
| 5 | 110000 | 110 | 52 | 0 |
| 6 | 110000 | 110 | 72 | 0 |
| 7 | 110000 | 110 | 49 | 0 |

Production Example of Dispersed Solution of Ester Group-Containing Olefin-Based Copolymer Fine Particles 1

Toluene (available from Wako Pure Chemical Industries, Ltd.): 300 parts

Ester group-containing olefin-based copolymer 1: 100 parts

The materials listed above were weighed out, mixed and dissolved at 90° C.

Separately, 5.0 parts of sodium dodecylbenzene sulfonate and 10.0 parts of sodium laurate were added to 700 parts of ion exchanged water, and dissolved by heating at 90° C. This solution and the toluene solution mentioned above were mixed together and stirred at 7000 rpm using a T.K. Robomix ultrahigh speed stirrer (available from Primix Corporation). The obtained mixture was then emulsified at a pressure of 200 MPa using a Nanomizer high pressure impact disperser (available from Yoshida Kikai Co., Ltd.). An aqueous dispersed solution containing ester group-containing olefin-based copolymer fine particles 1 at a concentration of 20% (a dispersed solution of ester group-containing olefin-based copolymer fine particles 1) was then obtained by removing the toluene using an evaporator and adjusting the concentration by means of ion exchanged water.

The 50% particle diameter on a volume basis (D50) of ester group-containing olefin-based copolymer fine particles 1 was 0.40 μm.

Production Examples of Dispersed Solutions of Ester Group-Containing Olefin-Based Copolymer Fine Particles 2 to 10

Dispersed solutions of ester group-containing olefin-based copolymer fine particles 2 to 10 were obtained by carrying out emulsification in the same way as in the production example of the dispersed solution of ester group-containing olefin-based copolymer fine particles 1, except that the ester group-containing olefin-based copolymer was changed in the manner shown in Table 5. Physical properties are shown in Table 5.

TABLE 5

| Dispersed solution of | Toluene solution | | | Aqueous solution | | |
|---|---|---|---|---|---|---|
| ester group-containing olefin-based copolymer | Toluene | Ester group-containing olefin-based copolymer | | Sodium dodecyl-benzene sulfonate | Sodium laurate | Physical properly D50 |
| fine particles | (parts) | Type | (parts) | (parts) | (parts) | (μm) |
| 1 | 300 | 1 | 100 | 5 | 10 | 0.4 |
| 2 | 300 | 2 | 100 | 5 | 10 | 0.4 |
| 3 | 300 | 3 | 100 | 5 | 10 | 0.4 |
| 4 | 300 | 4 | 100 | 5 | 10 | 0.4 |
| 5 | 300 | 5 | 100 | 5 | 10 | 0.4 |
| 6 | 300 | 6 | 100 | 5 | 10 | 0.4 |
| 7 | 300 | 7 | 100 | 5 | 10 | 0.4 |
| 8 | 300 | 8 | 100 | 5 | 10 | 0.4 |
| 9 | 300 | 9 | 100 | 5 | 10 | 0.4 |
| 10 | 300 | 10 | 100 | 5 | 10 | 0.4 |

Production Example of Olefin-Based Copolymer Containing Carboxyl Group-Containing Acid Group Fine Particle 1-Dispersed Solution Toluene (available from Wako Pure Chemical Industries, Ltd.): 300 parts Olefin-based copolymer 1 containing a carboxyl group-containing acid group: 100 parts The materials listed above were weighed out, mixed and dissolved at 90° C.

Separately, 5.0 parts of sodium dodecylbenzene sulfonate, 10.0 parts of sodium laurate and 6.4 parts of N,N-dimethylaminoethanol were added to 700 parts of ion exchanged water, and dissolved by heating at 90° C. This solution and the toluene solution mentioned above were mixed together and stirred at 7000 rpm using a T.K. Robomix ultrahigh speed stirrer (available from Primix Corporation). The obtained mixture was then emulsified at a pressure of 200 MPa using a Nanomizer high pressure impact disperser (available from Yoshida Kikai Co., Ltd.). An aqueous dispersed solution containing olefin-based copolymer containing a carboxyl group-containing acid group fine particles 1 at a concentration of 20% (olefin-based copolymer containing a carboxyl group-containing acid group fine particle 1-dispersed solution) was then obtained by removing the toluene using an evaporator and adjusting the concentration by means of ion exchanged water.

The 50% particle diameter on a volume basis (D50) of olefin-based copolymer containing a carboxyl group-containing acid group fine particles 1 was 0.40 μm.

Production Example of Dispersed Solution of Amorphous Resin Fine Particles 1

Tetrahydrofuran (available from Wako Pure Chemical Industries, Ltd.): 300 parts

Amorphous resin 1: 100 parts

Anionic surfactant (Neogen RK available from DKS Co. Ltd.): 0.5 parts

The materials listed above were weighed out, mixed and dissolved.

Next, 20.0 parts of 1 mol/L aqueous ammonia was added and stirred at 4000 rpm using a T.K. Robomix ultrahigh speed stirrer (available from Primix Corporation). 700 parts of ion exchanged water was then added at a rate of 8 g/min so as to precipitate amorphous resin fine particles. An aqueous dispersed solution containing amorphous resin fine particles 1 at a concentration of 20% (a dispersed solution of amorphous resin fine particles 1) was then obtained by removing the tetrahydrofuran using an evaporator and adjusting the concentration by means of ion exchanged water.

The 50% particle diameter on a volume basis (D50) of amorphous resin fine particles 1 was 0.13 μm.

Production Examples of Dispersed Solutions of Amorphous Resin Fine Particles 2 to 7

Dispersed solutions of amorphous resin fine particles 2 to 7 were obtained by carrying out similar emulsification to that used in the production example of the dispersed solution of amorphous resin fine particles 1, except that the amorphous resin was changed in the manner shown in Table 6. Physical properties are shown in Table 6.

TABLE 6

| Dispersed solution of amorphous resin fine | Tetra-hydro-furan | Amorphous resin | | Anionic surfactant (Neogen RK) | Aqueous ammonia | Physical property D50 |
|---|---|---|---|---|---|---|
| particles | (parts) | Type | (parts) | (parts) | (parts) | (μm) |
| 1 | 300 | 1 | 100 | 0.5 | 20 | 0.13 |
| 2 | 300 | 2 | 100 | 0.5 | 20 | 0.13 |
| 3 | 300 | 3 | 100 | 0.5 | 20 | 0.13 |
| 4 | 300 | 4 | 100 | 0.5 | 20 | 0.13 |
| 5 | 300 | 5 | 100 | 0.5 | 20 | 0.13 |
| 6 | 300 | 6 | 100 | 0.5 | 20 | 0.13 |
| 7 | 300 | 7 | 100 | 0.5 | 20 | 0.13 |

Production Example of Silicone Oil Fine Particle-Dispersed Solution

Silicone oil: 100 parts (Dimethylsilicone oil KF96-500CS, available from Shin-Etsu Chemical Co., Ltd. Kinematic viscosity 500 $mm^2/s$)

Anionic surfactant (Neogen RK available from DKS Co. Ltd.): 5 parts

Ion exchanged water: 395 parts

An aqueous dispersed solution containing silicone oil fine particles at a concentration of 20% (a silicone oil fine particle-dispersed solution) was prepared by mixing and dissolving the components listed above and dispersing for approximately 1 hour using a Nanomizer high pressure impact disperser (available from Yoshida Kikai Co., Ltd.) so as to disperse the silicone oil.

The 50% particle diameter on a volume basis (D50) of the silicone oil fine particles was 0.09 μm.

Production Example of Aliphatic Hydrocarbon Compound Fine Particle-Dispersed Solution Aliphatic hydrocarbon compound (HNP-51, available from Nippon Seiro Co., Ltd.): 100 parts Anionic surfactant (Neogen RK available from DKS Co. Ltd.): 5 parts Ion exchanged water: 395 parts The materials listed above were weighed out and placed in a mixing vessel equipped with a stirring device, heated to 90° C. and subjected to dispersion treatment for 60 minutes by being circulated in a Clearmix W-Motion (available from M Technique Co., Ltd.). The dispersion treatment conditions were as follows.

Outer diameter of rotor: 3 cm

Clearance: 0.3 mm

Rotational speed of rotor: 19,000 rpm

Rotational speed of screen: 19,000 rpm

Following the dispersion treatment, an aqueous dispersed solution containing aliphatic hydrocarbon compound fine particles at a concentration of 20% (an aliphatic hydrocarbon compound fine particle-dispersed solution) was obtained by cooling to 40° C. at a rotor rotational speed of 1000 rpm, a screen rotational speed of 0 rpm and a cooling rate of 10° C./min.

The 50% particle diameter on a volume basis (D50) of the aliphatic hydrocarbon compound fine particles was 0.15 μm.

Production of Colorant Fine Particle-dispersed Solution

Colorant: 50.0 parts (Cyan pigment, Pigment Blue 15:3 available from Dainichiseika Color and Chemicals Mfg. Co., Ltd.)

Anionic surfactant (Neogen RK available from DKS Co. Ltd.): 7.5 parts

Ion exchanged water: 442.5 parts

An aqueous dispersed solution containing colorant fine particles at a concentration of 10% (a colorant fine particle-dispersed solution) was obtained by weighing out, mixing and dissolving the materials listed above and dispersing for approximately 1 hour using a Nanomizer high pressure impact disperser (available from Yoshida Kikai Co., Ltd.) so as to disperse the colorant.

The 50% particle diameter on a volume basis (D50) of the colorant fine particles was 0.20 μm.

Production Example of Toner 1

Ester group-containing olefin-based copolymer fine particle 1-dispersed solution: 300 parts Olefin-based copolymer containing a carboxyl group-containing acid group fine particle 1-dispersed solution: 100 parts (The components listed above are the resin 1 that forms the core)

Silicone oil fine particle-dispersed solution: 125 parts

Aliphatic hydrocarbon compound fine particle-dispersed solution: 150 parts

Colorant fine particle-dispersed solution: 80 parts

Ion exchanged water: 160 parts

The materials listed above were placed in a round stainless steel flask and mixed, after which 60 parts of a 10% aqueous solution of magnesium sulfate was added. Next, the obtained mixed solution was dispersed for 10 minutes at 5000 rpm using a homogenizer (Ultra-turrax T50 available from IKA®-Werke GmbH & Co. KG). The mixed solution was then heated to 73° C. in a heating water bath while appropriately adjusting the speed of rotation of a stirring blade so that the mixed solution was stirred. After maintaining a temperature of 73° C. for 5 minutes, the weight-average particle diameter of formed aggregate particles was confirmed as appropriate using a Coulter Multisizer III, and when aggregate particles having a weight-average particle diameter (D4) of approximately 5.2 μm had been formed, the undermentioned material for the resin 2, which forms the shell, was introduced over a period of 3 minutes.

Amorphous resin fine particle 1-dispersed solution: 100 parts

Following the introduction, a temperature of 73° C. was maintained for 10 minutes, after which the weight-average particle diameter (D4) of formed aggregate particles was measured using a Coulter Multisizer III, and it was confirmed that aggregate particles having sizes of approximately 6.2 μm were formed.

330 parts of a 5% aqueous solution of sodium ethylenediaminetetraacetate was then added to the aggregate particle-dispersed solution, and the obtained mixture was heated to 98° C. while continuing the stirring. The aggregate particles were fused together by maintaining a temperature of 98° C. for 1 hour.

Crystallization of the ethylene-vinyl acetate copolymer was then facilitated by cooling to 50° C. and maintaining this temperature for 3 hours. The copolymer was then cooled to 25° C., filtered and subjected to solid-liquid separation, and the obtained filtered product was then washed with a 5% aqueous solution of sodium ethylenediaminetetraacetate and then washed with ion exchanged water. Following completion of the washing, toner particles 1 having a weight-average particle diameter (D4) of approximately 6.1 μm were obtained by drying with a vacuum dryer.

The toner 1 was obtained by mixing 100 parts of the obtained toner particles 1 with 1.0 parts of hydrophobic silica fine particles (BET: 200 $m^2/g$), which had been surface treated with hexamethyldisilazane, and 1.0 parts of titanium oxide fine particles (BET: 80 $m^2/g$), which had been surface treated with isobutyltrimethoxysilane, for 10 minutes at a rotational speed of 30 $s^{-1}$ using an FM-75 HENSCHEL mixer (available from Mitsui Miike Chemical Engineering Machinery, Co., Ltd.). The constituent materials of toner 1 are shown in Table 7.

Toner 1 had a weight-average particle diameter (D4) of 6.1 μm, an average circularity of 0.975 and a softening point (Tm) of 90° C. Physical properties of toner 1 are shown in Table 8.

TABLE 7

| | Formulation | | | | | | | | | |
|---|---|---|---|---|---|---|---|---|---|---|
| | Core: Resin 1 | | | | | | Shell: Resin 2 | | | |
| | Dispersed solution of ester group-containing olein-based copolymer fine particles | | Dispersed solution of fine particles of olefin-based copolymer containing a carboxyl group-containing acid group | | Dispersed solution of amorphous polyester resin fine particles | | Dispersed solution of amorphous resin fine particles | | Dispersed solution of ester group-containing olein-based copolymer fine paricles | |
| Toner | Type | (parts) | Type | (parts) | Type | (parts) | Type | (parts) | Type | (parts) |
| 1 | 1 | 300 | 1 | 100 | — | — | 1 | 100 | — | — |
| 2 | 1 | 300 | 1 | 100 | — | — | 2 | 100 | — | — |
| 3 | 2 | 300 | 1 | 100 | — | — | 2 | 100 | — | — |
| 4 | 3 | 300 | 1 | 100 | — | — | 2 | 100 | — | — |
| 5 | 4 | 300 | 1 | 100 | — | — | 2 | 100 | — | — |
| 6 | 5 | 300 | 1 | 100 | — | — | 2 | 100 | — | — |
| 7 | 5 | 244 | 1 | 100 | — | — | 2 | 100 | — | — |
| 8 | 5 | 360 | 1 | 100 | — | — | 2 | 100 | — | — |
| 9 | 5 | 400 | — | 156 | — | — | 2 | 100 | — | — |
| 10 | 5 | 400 | — | 40 | — | — | 3 | 100 | — | — |
| 11 | 5 | 400 | — | — | — | — | 3 | 60 | 5 | 40 |
| 12 | 5 | 400 | — | — | — | — | 3 | 40 | 5 | 60 |
| 13 | 5 | 400 | — | — | — | — | 4 | 40 | 5 | 60 |
| 14 | 5 | 400 | — | — | — | — | 5 | 40 | 5 | 60 |
| 15 | 6 | 400 | — | — | — | — | 3 | 40 | 6 | 60 |
| 16 | 7 | 400 | — | — | — | — | 3 | 40 | 7 | 60 |
| 17 | 5 | 240 | — | — | 3 | 160 | 3 | 40 | 5 | 60 |
| 18 | 8 | 400 | — | — | — | — | 3 | 40 | 5 | 60 |
| 19 | 5 | 160 | — | — | 3 | 240 | 3 | 40 | 5 | 60 |
| 20 | 9 | 400 | — | — | — | — | 3 | 40 | 9 | 60 |
| 21 | 10 | 400 | — | — | — | — | 3 | 40 | 10 | 60 |
| 22 | 5 | 400 | — | — | — | — | 6 | 40 | 5 | 60 |
| 23 | 5 | 400 | — | — | — | — | 7 | 40 | 5 | 60 |

TABLE 8

| | Physical properties | | | | | |
|---|---|---|---|---|---|---|
| | | | | Toner | | |
| | Core: Resin 1 | Shell: Resin 2 | | Weight-average particle diameter D4 (μm) | | |
| Toner | tanδ 1(70° C.-90° C.) < 1 | tanδ 2(70° C.-90° C.) > 1 | Tg (° C.) | | Circularity | Tm (° C.) |
| 1 | 0.6 | 1.5 | 60 | 6.1 | 0.975 | 90 |
| 2 | 0.6 | 0.9 | 67 | 6.1 | 0.975 | 92 |
| 3 | 0.5 | 0.9 | 67 | 6.1 | 0.975 | 91 |
| 4 | 0.7 | 0.9 | 67 | 6.1 | 0.975 | 93 |
| 5 | 0.4 | 0.9 | 67 | 6.1 | 0.975 | 90 |
| 6 | 0.8 | 0.9 | 67 | 6.1 | 0.975 | 94 |
| 7 | 0.8 | 0.9 | 67 | 6.1 | 0.975 | 94 |
| 8 | 0.8 | 0.9 | 67 | 6.1 | 0.975 | 92 |
| 9 | 0.8 | 0.9 | 67 | 6.1 | 0.975 | 91 |
| 10 | 0.8 | 0.8 | 67 | 6.1 | 0.975 | 91 |
| 11 | 0.8 | 0.8 | 67 | 6.1 | 0.975 | 90 |
| 12 | 0.8 | 0.8 | 67 | 6.1 | 0.975 | 90 |
| 13 | 0.8 | 0.7 | 70 | 6.1 | 0.975 | 91 |
| 14 | 0.8 | 2.0 | 52 | 6.1 | 0.975 | 91 |
| 15 | 0.3 | 0.8 | 67 | 6.1 | 0.975 | 89 |
| 16 | 0.9 | 0.8 | 67 | 6.1 | 0.975 | 96 |
| 17 | 0.8 | 0.8 | 67 | 6.1 | 0.975 | 99 |
| 18 | 0.9 | 0.8 | 67 | 6.1 | 0.975 | 90 |
| 19 | 0.8 | 0.8 | 67 | 6.1 | 0.975 | 103 |
| 20 | 0.3 | 0.8 | 67 | 6.1 | 0.975 | 88 |
| 21 | 1.0 | 0.8 | 67 | 6.1 | 0.975 | 97 |
| 22 | 0.8 | 0.6 | 72 | 6.1 | 0.975 | 91 |
| 23 | 0.8 | 2.5 | 49 | 6.1 | 0.975 | 91 |

In the table, the numerical values for tan $\delta_{1(70° C.-90° C.)}$ indicate the maximum values within the ranges, and the numerical values for tan $\delta_{2(70° C.-90° C.)}$ indicate the minimum values within the ranges.

Production Examples of Toners 2 to 23

Toners 2 to 23 were obtained by carrying out a similar procedure to that used in the production example of toner 1, except that the materials of the resin 1 and the resin 2 were changed in the manner shown in Table 7. Physical properties are shown in Table 8.

Moreover, in toners 11 to 23, in which two types of resin were used in the resin 2, the Tg values of the resin 2 were the same as that of the amorphous resin used. This is thought to be because the Tg value of the amorphous resin was detected as a result of the amorphous resin and olefin-based resin that constitute the resin 2 being present in a phase-separated state.

Production Example of Magnetic Core Particle 1

Step 1 (Weighing out/mixing step):

$Fe_2O_3$: 62.7 parts $MnCO_3$: 29.5 parts $Mg(OH)_2$: 6.8 parts $SrCO_3$: 1.0 parts The ferrite raw materials were weighed out so that the materials listed above had the compositional ratio mentioned above. Next, the materials were pulverized and mixed for 5 hours in a dry vibrating mill using stainless steel beads having diameters of ⅛ inch.

Step 2 (Pre-baking step):

The obtained pulverized product was formed into pellets measuring approximately 1 mm square using a roller compactor. Coarse particles were removed from these pellets using a vibrating sieve having an opening size of 3 mm, after which fine particles were removed using a vibrating sieve having an opening size of 0.5 mm, and a pre-baked ferrite was then prepared by firing for 4 hours at 1000° C. in a nitrogen atmosphere (oxygen concentration: 0.01 vol %) using a burner type kiln. The composition of the obtained pre-baked ferrite was as follows.

$$(MnO)_a(MgO)_b(SrO)_c(Fe_2O_3)_d$$

In the formula above, a=0.257, b=0.117, c=0.007 and d=0.393

Step 3 (Pulverization step):

The obtained pre-baked ferrite was pulverized to a size of approximately 0.3 mm using a crusher, water was added in an amount of 30 parts relative to 100 parts of the pre-baked ferrite, and the pre-baked ferrite was then pulverized for 1 hour in a wet ball mill using zirconia beads having diameters of ⅛ inch. The obtained slurry was pulverized for 4 hours in a wet ball mill using alumina beads having diameters of 1/16 inch to obtain a ferrite slurry (a finely pulverized pre-baked ferrite).

Step 4 (Granulating step):

1.0 parts of ammonium polycarboxylate as a dispersing agent and 2.0 parts of poly(vinyl alcohol) as a binder, each relative to 100 parts of the pre-baked ferrite, were added to the ferrite slurry, and the slurry was then granulated into spherical particles using a spray dryer (manufactured by Ohkawara Kakohki Co., Ltd.). After adjusting the diameters of the obtained particles, the particles were heated for 2 hours at 650° C. using a rotary kiln, and organic components, such as the dispersing agent and binder, were removed.

Step 5 (Firing step):

In order to control the firing atmosphere, the temperature was increased from room temperature to 1300° C. over a period of 2 hours in a nitrogen atmosphere (oxygen concentration: 1.00 vol %) using an electric furnace, after which firing was carried out for 4 hours at a temperature of 1150° C. The temperature was then lowered to 60° C. over a period of 4 hours, the nitrogen atmosphere was allowed to return to an air atmosphere, and the fired product was taken out at a temperature of 40° C. or lower.

Step 6 (Sorting step):

After crushing the aggregated particles, particles having a low magnetic force were removed by means of magnetic separation, coarse particles were removed by sieving with a sieve having an opening size of 250 μm so as to obtain magnetic core particles 1 having a 50% particle diameter on a volume basis (D50) of 37.0 μm.

<Preparation of Coating Resin 1>

Cyclohexyl methacrylate monomer: 26.8 mass %
Methyl methacrylate monomer: 0.2 mass %
Methyl methacrylate macromonomer: 8.4 mass %
(Macromonomer having a weight average molecular weight of 5000 and having a methacryloyl group at one terminal)
Toluene: 31.3 mass %
Methyl ethyl ketone: 31.3 mass %
Azobisisobutyronitrile: 2.0 mass %

Among the materials listed above, the cyclohexyl methacrylate monomer, methyl methacrylate monomer, methyl methacrylate macromonomer, toluene and methyl ethyl ketone were placed in a four-mouth separable flask equipped with a reflux condenser, a temperature gauge, a nitrogen inlet tube and a stirrer, and nitrogen gas was introduced so as to obtain a satisfactory nitrogen atmosphere. The temperature was then increased to 80° C., the azobisisobutyronitrile was added, and polymerization was carried out for 5 hours while refluxing. Hexane was introduced into the obtained reaction product so as to precipitate a copolymer, and the precipitate was filtered and then vacuum dried so as to obtain coating resin 1.

Next, 30 parts of coating resin 1 was dissolved in 40 parts of toluene and 30 parts of methyl ethyl ketone so as to obtain polymer solution 1 (solid content: 30 mass %).

Preparation of Coating Resin Solution 1

Polymer solution 1 (solid resin content concentration 30%): 33.3 mass %
Toluene: 66.4 mass %
Carbon black (Regal 330 available from Cabot): 0.3 mass % (Primary particle diameter: 25 nm, nitrogen adsorption specific surface area: 94 $m^2/g$, DBP absorption: 75 mL/100 g)

The materials listed above were dispersed for 1 hour in a paint shaker using zirconia beads having diameters of 0.5 mm. The obtained dispersed solution was filtered using a 5.0 μm membrane filter to obtain coating resin solution 1.

Production Example of Magnetic Carrier 1

(Resin Coating Step):

The magnetic core particles 1 and coating resin solution 1 were introduced into a vacuum deaeration type kneader maintained at normal temperature (the amount of coating resin solution introduced was such that the amount of resin component was 2.5 parts relative to 100 parts of the magnetic core particles 1). Following the introduction, stirring was carried out for 15 minutes at a rotational speed of 30 rpm, and after at least a certain amount (80 mass %) of the solvent had evaporated, the temperature was increased to 80° C. while mixing under reduced pressure, toluene was distilled off over a period of 2 hours, and cooling was then carried out. Magnetic carrier 1 having a 50% particle diameter on a volume basis (D50) of 38.2 μm was then obtained by separating particles having a low magnetic force from the obtained magnetic carrier by means of magnetic separation, passing the magnetic carrier through a sieve having an opening size of 70 μm, and then classifying using an air classifier.

Production Example of Two Component Developer 1

Two component developer 1 was obtained by mixing 92.0 parts of magnetic carrier 1 and 8.0 parts of toner 1 using a V type mixer (a V-20 available from Seishin Enterprise Co., Ltd.).

Production Examples of Two Component Developers 2 to 23

Two component developers 2 to 23 were obtained using a similar procedure to that used in the production example of two component developer 1, except that the formulation was altered in the manner shown in Table 9.

TABLE 9

| Example or Comparative example | Two component developer | Toner | Magnetic carrier |
|---|---|---|---|
| Example 1 | 1 | 1 | 1 |
| Example 2 | 2 | 2 | 1 |

TABLE 9-continued

| Example or Comparative example | Two component developer | Toner | Magnetic carrier |
|---|---|---|---|
| Example 3 | 3 | 3 | 1 |
| Example 4 | 4 | 4 | 1 |
| Example 5 | 5 | 5 | 1 |
| Example 6 | 6 | 6 | 1 |
| Example 7 | 7 | 7 | 1 |
| Example 8 | 8 | 8 | 1 |
| Example 9 | 9 | 9 | 1 |
| Example 10 | 10 | 10 | 1 |
| Example 11 | 11 | 11 | 1 |
| Example 12 | 12 | 12 | 1 |
| Example 13 | 13 | 13 | 1 |
| Example 14 | 14 | 14 | 1 |
| Example 15 | 15 | 15 | 1 |
| Example 16 | 16 | 16 | 1 |
| Example 17 | 17 | 17 | 1 |
| Example 18 | 18 | 18 | 1 |
| Comparative example 1 | 19 | 19 | 1 |
| Comparative example 2 | 20 | 20 | 1 |
| Comparative example 3 | 21 | 21 | 1 |
| Comparative example 4 | 22 | 22 | 1 |
| Comparative example 5 | 23 | 23 | 1 |

Example 1

Evaluations were carried out using the two component developer 1.

A modified printer obtained by modifying an imageRUNNER ADVANCE C9075 PRO industrial digital printer available from Canon Inc. was used as an image forming apparatus, and two component developer 1 was introduced into the cyan developing device. The apparatus was modified so that the fixing temperature, the processing speed, the direct current voltage $V_{DC}$ of the developer bearing member, the charging voltage $V_D$ of the electrostatic latent image bearing member and the laser power could be freely set. Image output evaluations were carried out by outputting FFh images (solid images) having a prescribed image ratio, adjusting $V_{DC}$, $V_D$ and laser power so that the toner laid-on levels of the FFh images were prescribed values, and carrying out the evaluations described below. FFh is a value that indicates 256 colors as hexadecimal numbers, with 00h denoting the first gradation of 256 colors (a white background part), and FFh denoting the 256th of 256 colors (a solid part).

Evaluations were carried out on the basis of the evaluation methods described below, and the results are shown in Table 10.

[Transfer Efficiency]

Paper: CS-680 (68.0 g/m$^2$) (sold by Canon Marketing Japan Inc.)

Evaluation image: An image measuring 2 cm×5 cm was disposed in the center of an A4 sheet of the paper mentioned above Toner laid-on level on paper: 0.35 mg/cm$^2$ (FFh image)

(Adjusted by altering the direct current voltage $V_{DC}$ of the developer bearing member, the charging voltage $V_D$ of the electrostatic latent image bearing member and the laser power)

Test environment: High temperature high humidity environment (temperature: 30° C., humidity: 80% RH (hereinafter abbreviated to H/H))

In order to evaluate the stability and durability of the evaluation device, 10,000 prints of a belt chart having an image ratio of 0.1% were outputted on sheets of A4 paper. The evaluation image was then formed on an electrostatic latent image bearing member and transferred to an intermediate transfer member, and the evaluation device was stopped before the evaluation image was transferred to a recording paper. The intermediate transfer member was removed from the stopped evaluation device, a transparent adhesive tape was bonded to the transferred image so as to collect the toner, and the adhesive tape was bonded to a recording paper. The image density was measured using an optical density system, and the transfer density A was determined by subtracting the density at those locations where only the adhesive tape was bonded to the recording paper. In addition, the electrostatic latent image bearing member of the evaluation device was removed, and the transfer residual density B was determined for untransferred toner using the same method. Transparent weakly adhesive Super Stick (available from Lintec Corporation) was used as the adhesive tape, and an X-Rite color reflection densitometer (available from X-Rite, Incorporated) was used as an optical density meter. In addition, transfer efficiency was calculated using the formula below. The obtained transfer efficiency was evaluated according to the evaluation criteria shown below. C or above was deemed to be good.

$$\text{Transfer efficiency}=\{\text{transfer density } A/(\text{transfer density } A+\text{transfer residual density } B)\}\times 100$$

(Evaluation Criteria)

A: Transfer efficiency is at least 98.0%

B: Transfer efficiency is at least 95.0% but less than 98.0%

C: Transfer efficiency is at least 92.0% but less than 95.0%

D: Transfer efficiency is at least 90.0% but less than 92.0%

E: Transfer efficiency less than 90.0%

[Low-Temperature Fixability at Low Toner Laid-on Level]

Paper: CS-680 (68.0 g/m$^2$) (sold by Canon Marketing Japan Inc.)

Toner laid-on level on paper: 0.10 mg/cm$^2$ (3Fh image)

(Adjusted by altering the direct current voltage $V_{DC}$ of the developer bearing member, the charging voltage $V_D$ of the electrostatic latent image bearing member and the laser power)

Evaluation image: An image measuring 2 cm×5 cm was disposed in the center of an A4 sheet of the paper mentioned above Fixing test environment: Low temperature low humidity environment: Temperature: 15° C., humidity: 10% RH (hereinafter abbreviated to "L/L")

Fixing temperature: 150° C.

Processing speed: 377 mm/sec

The evaluation image mentioned above was outputted and low-temperature fixability was evaluated. The fogging value is an indicator for evaluating low-temperature fixability. The fogging value was measured by first measuring the average reflectance Dr (%) of the evaluation paper prior to the fixing test using a reflectometer (REFLECTOMETER MODEL TC-6DS, available from Tokyo Denshoku Co., Ltd.). Next, following the fixing test, the reflectance Ds (%) was measured for those parts on which the evaluation image could not be fixed on white background parts and cold offsetting occurred. In addition, the fogging value was calculated using the formula below. The obtained fogging value was evaluated using the evaluation criteria shown below. C or above was deemed to be good.

$$\text{Fogging}=Dr\ (\%)-Ds\ (\%)$$

(Evaluation Criteria)

A: Fogging less than 0.2%

B: Fogging is at least 0.2% but less than 0.5%

C: Fogging is at least 0.5% but less than 0.8%

D: Fogging is at least 0.8% but less than 1.0%

E: Fogging is at least 1.0%

[Toner Scattering]

Paper: CS-680 (68.0 g/m$^2$) (sold by Canon Marketing Japan Inc.) Evaluation image: An image measuring 2 cm×5 cm was disposed in the center of an A4 sheet of the paper mentioned above Toner laid-on level on paper: 0.35 mg/cm$^2$ (FFh image) (Adjusted by altering the direct current voltage $V_{DC}$ of the developer bearing member, the charging voltage $V_D$ of the electrostatic latent image bearing member and the laser power)

Test environment: High temperature high humidity environment (temperature: 30° C., humidity: 80% RH (hereinafter abbreviated to H/H))

In order to evaluate the stability of the evaluation device, 10 prints of a belt chart having an image ratio of 0.1% were outputted on sheets of A4 paper. Next, a developing device was placed in the evaluation device in an H/H environment and left to stand for 2 weeks, after which the developing device was removed, an A4 sheet of paper was placed directly below the center of the developer bearing member, and the developer bearing member was rotated at the same peripheral speed as the main machine for 10 minutes. The mass of toner that fell onto the paper was measured and evaluated in accordance with the evaluation criteria shown below. C or above was deemed to be good.

(Evaluation Criteria)

A: Less than 3 mg

B: At least 3 mg but less than 6 mg

C: At least 6 mg but less than 10 mg

D: At least 10 mg but less than 15 mg

E: At least 15 mg

Examples 2 to 18 and Comparative Examples 1 to 5

Evaluations were carried out in the same way as in Example 1, except that two component developers 2 to 23 were used. The evaluation results are shown in Table 10.

TABLE 10

| | Transfer efficiency (%) | | | | Fixability at low toner laid-on level (%) | | Toner scattering (mg) | |
|---|---|---|---|---|---|---|---|---|
| | | Transfer density A | Transfer residual density B | Transfer efficiency | | Fogging | | Mass |
| Example 1 | A | 1.35 | 0.00 | 100.0% | A | 0.0% | A | 0 |
| Example 2 | A | 1.35 | 0.00 | 100.0% | A | 0.1% | A | 0 |
| Example 3 | A | 1.33 | 0.02 | 98.5% | A | 0.0% | A | 0 |
| Example 4 | A | 1.33 | 0.02 | 98.5% | B | 0.2% | A | 0 |
| Example 5 | B | 1.32 | 0.03 | 97.8% | A | 0.0% | A | 0 |
| Example 6 | B | 1.32 | 0.03 | 97.8% | B | 0.3% | A | 0 |

TABLE 10-continued

| | Transfer efficiency (%) | | | | Fixability at low toner laid-on level (%) | | Toner scattering (mg) | |
|---|---|---|---|---|---|---|---|---|
| | | Transfer density A | Transfer residual density B | Transfer efficiency | | Fogging | | Mass |
| Example 7 | B | 1.32 | 0.03 | 97.8% | B | 0.4% | A | 0 |
| Example 8 | B | 1.32 | 0.03 | 97.8% | B | 0.4% | A | 2 |
| Example 9 | B | 1.32 | 0.03 | 97.8% | C | 0.5% | B | 4 |
| Example 10 | B | 1.32 | 0.03 | 97.8% | C | 0.6% | C | 6 |
| Example 11 | B | 1.32 | 0.03 | 97.8% | C | 0.7% | C | 9 |
| Example 12 | B | 1.32 | 0.03 | 97.8% | D | 0.8% | D | 10 |
| Example 13 | B | 1.32 | 0.03 | 97.8% | D | 0.9% | D | 10 |
| Example 14 | C | 1.28 | 0.07 | 94.8% | C | 0.7% | D | 10 |
| Example 15 | D | 1.24 | 0.11 | 91.9% | C | 0.7% | D | 10 |
| Example 16 | C | 1.28 | 0.07 | 94.8% | D | 0.9% | D | 10 |
| Example 17 | D | 1.24 | 0.11 | 91.9% | D | 0.9% | D | 10 |
| Example 18 | B | 1.32 | 0.03 | 97.8% | D | 0.9% | D | 10 |
| Comparative example 1 | E | 1.20 | 0.15 | 88.9% | E | 1.3% | C | 8 |
| Comparative example 2 | E | 1.21 | 0.14 | 89.6% | C | 0.6% | D | 10 |
| Comparative example 3 | C | 1.27 | 0.08 | 94.1% | E | 1.0% | E | 15 |
| Comparative example 4 | B | 1.32 | 0.03 | 97.8% | E | 1.2% | D | 10 |
| Comparative example 5 | E | 1.20 | 0.15 | 88.9% | C | 0.5% | D | 10 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-156450, filed Aug. 14, 2017, which is hereby incorporated by reference herein in its entirety.

What is claimed is:

1. A toner, comprising:

a toner particle having a core-shell structure that has a core formed from a resin 1 and a shell formed from a resin 2 on the surface of the core;

the resin 1 containing more than 50 mass % of an ester group-containing olefin-based copolymer having a monomer unit Y1 and a monomer unit Y2, said monomer unit Y1 being represented by formula (1) and said monomer unit Y2 being at least one member selected from the group consisting of monomer units represented by formula (2) and formula (3)

(1)

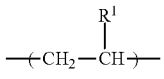

(2)

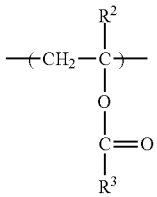

-continued (3)

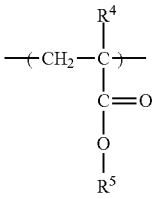

where $R^1$ denotes H or $CH_3$, $R^2$ denotes H or $CH_3$, $R^3$ denotes $CH_3$ or $C_2H_5$, $R^4$ denotes H or $CH_3$, and $R^5$ denotes $CH_3$ or $C_2H_5$, wherein an ester group concentration in the ester group-containing olefin-based copolymer is from 2 to 18 mass % relative to the total mass of the ester group-containing olefin-based copolymer, and resin 2 is an amorphous resin having a Tg value of 50 to 70° C.

2. The toner according to claim 1, wherein resin 2 contains more than 50 mass % of a polyester resin or more than 50 mass % of a styrene-acrylic resin.

3. The toner according to claim 1, wherein resin 1 contains an olefin-based copolymer containing a carboxyl group-containing acid group.

4. The toner according to claim 2, wherein resin 1 contains an olefin-based copolymer containing a carboxyl group-containing acid group.

5. The toner according to claim 3, wherein the content of the olefin-based copolymer containing a carboxyl group-containing acid group in the resin 1 is at least 10 mass % but less than 50 mass %.

6. The toner according to claim 4, wherein the content of the olefin-based copolymer containing a carboxyl group-containing acid group in resin 1 is 10 to less than 50 mass %.

7. The toner according to claim 1, wherein the melting point of the ester group-containing olefin-based copolymer is from 70° C. to 90° C., as measured using a differential scanning calorimeter.

8. The toner according to claim 1, wherein a value of tan $\delta_{1(70°\ C.-90°\ C.)}$ is always not more than 1.0 within the temperature range from 70° C. to 90° C. on a loss tangent (tan $\delta_1$) curve measured by a dynamic viscoelasticity test of resin 1, and a value of tan $\delta_{2(70°\ C.-90°\ C.)}$ is always at least 1.0 within the temperature range from 70° C. to 90° C. on a loss tangent (tan $\delta_2$) curve measured by the dynamic viscoelasticity test of resin 2.

* * * * *